US007310483B2

(12) United States Patent
Mizuno

(10) Patent No.: US 7,310,483 B2
(45) Date of Patent: Dec. 18, 2007

(54) IMAGE-FORMING APPARATUS AND IMAGE-FORMING METHOD FOR MAKING DEVELOPMENT USING LIGHT TONER AND DARK TONER WITH SUBSTANTIALLY THE SAME HUE

(75) Inventor: Manabu Mizuno, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 136 days.

(21) Appl. No.: 11/292,819

(22) Filed: Dec. 2, 2005

(65) Prior Publication Data

US 2006/0127114 A1 Jun. 15, 2006

(30) Foreign Application Priority Data

Dec. 9, 2004 (JP) ..... 2004-357132
Nov. 10, 2005 (JP) ..... 2005-326147

(51) Int. Cl.
*G03G 15/01* (2006.01)
*G03G 15/00* (2006.01)

(52) U.S. Cl. ..... 399/39; 399/49; 399/85; 399/223

(58) Field of Classification Search ..... 399/15, 399/39, 40, 41, 49, 60, 82, 85, 223; 358/521
See application file for complete search history.

(56) References Cited

U.S. PATENT DOCUMENTS 5,963,756 A * 10/1999 Sakai et al. ..... 399/39
6,498,910 B2 12/2002 Haneda
6,803,932 B2 * 10/2004 Itoh et al. ..... 358/521 X
6,819,902 B2 11/2004 Toyohara et al.
7,113,729 B2 * 9/2006 Toyohara ..... 399/223
7,120,368 B2 * 10/2006 Toyohara ..... 399/223 X

FOREIGN PATENT DOCUMENTS

JP 2001-290319 A 10/2001
JP 2004-145137 A 5/2004

* cited by examiner

*Primary Examiner*—Sandra L. Brase
(74) *Attorney, Agent, or Firm*—Canon U.S.A. Inc. I.P. Division

(57) ABSTRACT

In an image-forming apparatus being selectable between a four-color mode forming images using only cyan, magenta, yellow, and black toner and a six-color mode forming images using light cyan and light magenta toner in addition to the four-color toner, by automatically selecting the correction between density correction and gradation correction in the four-color mode and density correction and gradation correction in the six-color mode in accordance with an operation mode of the image-forming apparatus, variations in image density and gradation reproducibility can be effectively corrected for short and long periods in four-color and six-color modes.

8 Claims, 16 Drawing Sheets

400
408
MASKING / UCR UNIT
C1
M1
Y1
C2
M2
Y2
Bk2
409
SPACE FILTER UNIT
C3
M3
Y3
Bk3
410
IMAGE MEMORY UNIT
C4
M4
Y4
Bk4
411
SHADING DATA GENERATING UNIT
DC5
PC5
DM5
PM5
LINE DELAY UNIT
Y5
Bk5
412
414
LUT
DC6
PC6
DM6
PM6
Y6
Bk6
415
PWM
416
LASER DRIVER
DC7
PC7
DM7
PM7
Y7
Bk7
417
418
419
420
421
422
(SEMICONDUCTOR LASER)
PATTERN GENERATING UNIT
413
(X,Xp,Xd)

IMAGE-FORMING APPARATUS AND IMAGE-FORMING METHOD FOR MAKING DEVELOPMENT USING LIGHT TONER AND DARK TONER WITH SUBSTANTIALLY THE SAME HUE

BACKGROUND OF THE INVENTION

1. Field of the Invention

The present invention relates to an image-forming apparatus for forming images using toner with substantially the same hue and different densities, and its control method.

2. Description of the Related Art

An image-forming apparatus for forming images by an electrophotographic system includes a charging unit for uniformly charging a photosensitive surface of a photosensitive drum; a latent-image forming unit for forming latent images on the charged photosensitive surface corresponding to image information; a developing unit for developing the latent images with developer; a transfer unit for transferring the developed latent images on a recording material; and a fixing unit for fixing the transferred images on the recording material.

Developer (toner) used generally includes a single kind with a predetermined density for colors such as cyan, magenta, yellow, and black. However, when such a single-kind of density toner is used, in a highlight portion (low-density portion), a toner amount is reduced, so that there has been a difficulty with reproducibility in gradation (gray scale) of image data. Recently, users' demand level has been increased so that image-forming apparatuses using developer with the increased number of colors in comparison with a conventional image forming apparatus using four-color toner have been proposed. That is, an electrophotographic image-forming apparatus using toner with substantially the same hue and different densities is proposed in Japanese Patent Laid-Open No. 2001-290319 and No. 2004-145137.

Such image-forming apparatuses frequently use six-color developer for light cyan and light magenta as well as cyan, magenta, yellow, and black. The developer for light cyan and light magenta contains less pigment than that for normal cyan and normal magenta although its spectral characteristics are the same. The developer for normal cyan and normal magenta is referred to as dark toner and the developer for light cyan and light magenta is referred to as light toner herein. An image signal using dark toner during developing is referred to an image signal for dark toner while an image signal using light toner is referred to as an image signal for light toner.

FIG. 19 is a graph showing the relationship between image densities of image signals for dark toner and light toner and a toner coating weight/an output density. Solid line T1 and dotted chain line T2 in the graph show the relationship between the image densities of the image signals and the light toner coating weight/dark toner coating weight on recording sheets, respectively. Straight line m shows characteristics between the image density of the input image signal and the ideal output density, and the light toner coating weight/dark toner coating weight versus the image densities of the input image signals are determined so that the output density of the images formed with the light toner and the dark toner becomes ideal linear. If the maximum value of the image density of the input image signal is 1.8, over a region from a highlight portion (low density portion) being below 0.9 to an intermediate density portion, images are formed with only the light toner for reducing the image granulated effect. Over a region from the intermediate density portion being above an image density of 0.9 toward the high density, images are formed with both the dark toner and the light toner by suppressing the amount of the light toner.

However, in an image-forming apparatus for forming images using the dark toner and the light toner, the output characteristics of the dark toner and the light toner are changed, problems arise as follows.

For example, if the resistance of the surface layer of the photosensitive drum or the charged amount (tribo) of developer is reduced, the contrast potential (Vcont) is decreased, resulting in reduction of the output density due to changes in the toner coating weight.

This point will be described more in detail. Curved line I shows that the dark toner coating weight is reduced, and characteristics of the output density at this time are shown in curved line n. As is apparent from curved line n, in the intermediate density portion (about 0.9 image density) where images are started forming with the dark toner, the output density is rapidly changed. Accordingly, in the images using the intermediate density, the gradation may become artificial or a false outline may be generated.

In an image-forming apparatus using six-color developer (six-color toner), it is desirable to switch the image-forming mode between the high image-quality mode forming images with six colors and the normal mode using only four fundamental colors giving priority to reduction in toner consumption and improvement in the image-forming speed, in accordance with user's demands. Hence, in order to switch the operating mode between four-color output and six-color output in one apparatus, it is necessary to adjust the gradation and density so as to have optimum printed images in the respective four-color output and the six-color output.

SUMMARY OF THE INVENTION

The present invention has been made in view of the problems mentioned above so as to solve defects of the conventional examples mentioned above.

The present invention provides an image-forming apparatus capable of securely obtaining preferable gradation characteristics in both modes of the development using dark toner and light toner with substantially the same hue and the development without using the light toner, and its control method.

The present invention also provides an image-forming apparatus capable of stably outputting high-quality images in both modes of the output with six-color and the output with four-color by correcting deteriorated gradation due to changes in image-forming characteristics of dark toner and light toner, and its control method.

According to an aspect of the invention, an image-forming apparatus for making development using light toner and dark toner with substantially the same hue includes: an operation unit configured to select an operation mode including a first mode forming images using the light toner and the dark toner, a second mode forming images without using the light toner, and an automatic selection mode; a control unit configured to select an adjustment based on the operation mode selected by the operation unit, a first adjustment being selected when the operation mode is the first mode, a second adjustment being selected when the operation mode is the second mode, and any one of the first adjustment and the second adjustment being selected based on a default operation mode selected for operating the image-forming apparatus when the operation mode is the automatic selection mode; and a processing unit configured to make development based on the adjustment selected by the control unit.

The image-forming apparatus may further include a monochrome mode forming monochrome images as the operation mode; and an input unit for inputting an image signal, where the control unit is configured to select the operation mode based on the image signal from the input unit.

According to another aspect of the present invention, an image adjusting method in an image-forming apparatus for making development uses light toner and dark toner with substantially the same hue, the image-forming apparatus includes as operation modes of the image-forming apparatus a first mode forming images using the light toner and the dark toner; a second mode forming images without using the light toner; and an automatic selection mode making density correction and gradation correction based on fixed images on a recording sheet. The image adjusting method includes: obtaining the operation mode; and determining an adjustment based on the operation mode, where the adjustment is determined to be a first adjustment when the operation mode is the first mode, the adjustment is determined to be a second adjustment when the operation mode is the second mode, the adjustment is determined to be any one of the first adjustment and the second adjustment based on a default operation mode selected for operating the image-forming apparatus when the operation mode is an automatic selection mode; and making development based on the adjustment.

Further features of the present invention will be apparent from the following description when taken in conjunction with the accompanying drawings.

DESCRIPTION OF THE EMBODIMENTS

Exemplary Embodiments of the present invention will be described below with reference to the attached drawings. The exemplary embodiments should not be construed as restricting the invention in the claims.

Figure 1:
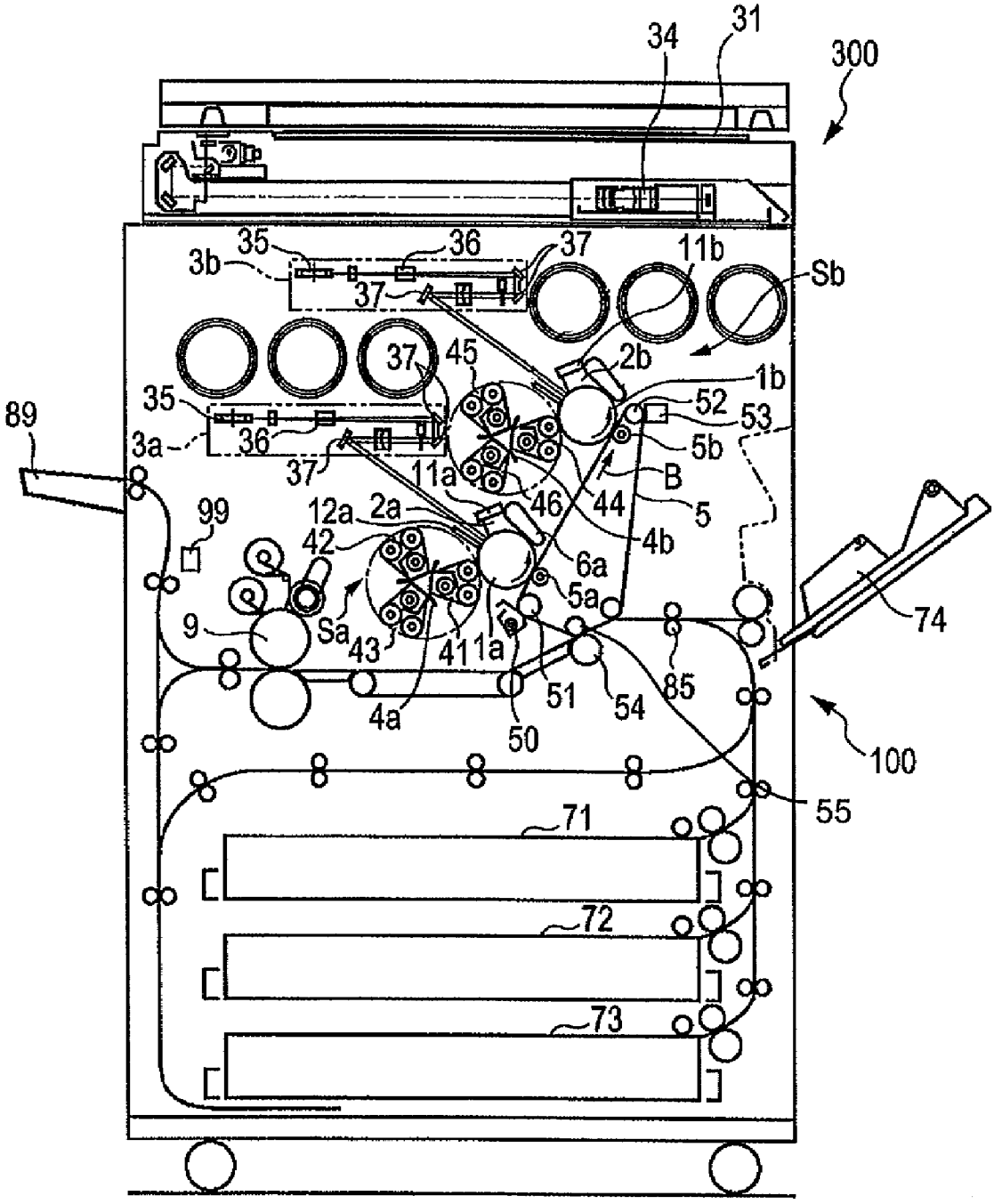
FIG. 1 is a plan view of an electrophotographic image-forming apparatus according to an exemplary embodiment of the present invention.

FIG. 1 is a plan view illustrating an electrophotographic image-forming apparatus according to an exemplary embodiment of the present invention. In this color image-forming apparatus, images are formed by an electrophotographic system using thick-density toner (referred to as dark toner herein) and light-density toner (referred to as light toner herein) with substantially the same hue and different densities.

That is, a color image-forming apparatus 100 includes six development units 41, 42, 43, 44, 45, and 46. The development unit 41 is charged with light cyan toner; the development 42 with yellow toner; the development 43 with magenta toner; the development 44 with light magenta toner; the development 45 with cyan toner; and the development 46 with black toner.

The toner with substantially the same hue and different densities means a kind of toner in that a color-forming ingredient (pigment) contained in the toner composed of a resin and the color-forming ingredient (pigment) as a base substance has the same spectral characteristics although the percentage content is different. The light toner means a kind of toner in that the density is relatively low in the combination of different densities with the same hue.

Substantially the same hue means that spectral characteristics of the color-forming ingredient (pigment) are the same as mentioned above; however, even if not identical in the strict sense, it is within the range being referable as the same color in a normal color concept, generally like magenta, cyan, yellow, and black.

According to exemplary embodiments of the present invention, in the toner with substantially the same hue and light density (light toner), the optical density after fixing is less than 1.0 for every toner amount of 0.5 mg/cm$^2$ on a recording material, while in thick-density toner (dark toner), the optical density after fixing is 1.0 or more for every toner amount of 0.5 mg/cm2 on the recording material.

According to exemplary embodiments, the amount of pigment in the dark toner is adjusted so as to have an optical density after fixing of 1.6 when the deposited amount of the dark toner is 0.5 mg/cm$^2$. The amount of pigment in the light toner is designed so as to have an optical density after fixing of 0.8 when the deposited amount of the dark toner is 0.5 mg/cm$^2$. By mixing the two-kind of thick and light toner, the gradation for each color is reproduced.

Color image-forming apparatus 100 includes two photosensitive image-carrier drums, i.e., a first photosensitive drum 1*a* and a second photosensitive drum 1*b*. The respective photosensitive drums 1*a* and 1*b* are rotated in the direction of the arrows.

Around the photosensitive drum 1*a*, a pre-exposure lamp 11*a*, a corona charger 2*a*, a laser exposure device 3*a*, a potential sensor 12*a*, a development rotary unit 4*a* having the development units 41 to 43 housed therein, a primary transfer roller 5*a*, and a cleaning unit 6*a* are arranged. A first image-forming section Sa is a general term for these. Around the photosensitive drum 1*b*, the same elements as above are arranged so as to form a second image-forming section Sb. These image-forming sections Sa and Sb are substantially identical in structure (shape) with each other for cost cutting. For example, the development units are substantially the same in structure and shape. Therefore, the development units 41 to 46 are replaceable for each other.

Adjacent to the first and second photosensitive drums 1*a* and 1*b*, a belt intermediate transfer body, i.e., an intermediate transfer belt 5, is stretched around rollers of first and second transfer rollers 5*a* and 5*b* functioning as primary transferring unit, a drive roller 51, and a roller 52. The first and second transfer rollers 5*a* and 5*b* abut the first and second photosensitive drums 1*a* and 1*b*, respectively, so as to form a primary transfer section. A secondary transfer roller 54 is arranged so as to pinch the intermediate transfer belt 5 with the roller 52 therebetween so as to form a secondary transfer section. The secondary transfer roller 54 can be brought into and out of contact with the intermediate transfer belt 5. A cleaner 50 is provided for removing residual toner on the intermediate transfer belt 5 movably into and out of contact with the intermediate transfer belt 5.

The image-forming operation in the image-forming apparatus will be described next.

Based on an image signal of a document image read by a reader unit 300, an image-forming start signal is generated. In addition to the image signal from the reader unit 300, an image signal from a computer and an image signal from a facsimile are transferred; however, the image-forming operation on the basis of the image signal transferred from the reader unit 300 will be described herein.

The photosensitive drums 1*a* and 1*b* rotating at a predetermined process speed of the image-forming sections Sa and Sb are electrically discharged with the pre-exposure lamps 11*a* and 11*b* and then uniformly charged in negative polarity with the corona chargers 2*a* and 2*b*. In the laser exposure devices 3*a* and 3*b*, the color-separated image signal input from the outside is radiated with semiconductor laser 36 so as to form electrostatic latent images for each color on the respective photosensitive drums 1*a* and 1*b* after passing through a polygon mirror 35 and a reflection mirror 37.

The operation thereafter will be described by classifying it into a high-quality color mode and a normal color mode.

The operation in the high-quality color mode (when forming images with six-color) will be described next.

On the electrostatic latent images formed on the upstream photosensitive drum 1*a*, the development rotary 4*a* is rotated so as to allow the development unit 41, which has development bias applied in the same polarity as charged polarity (negative) of the photosensitive drum 1*a*, to abut the photosensitive drum 1*a* so that the latent images are visualized as toner images by sticking light cyan toner thereto.

The light cyan toner images on the photosensitive drum 1*a* are primarily transferred on the intermediate transfer belt 5 with the transfer roller 5*a* applied in reverse (positive) polarity to that of the primary transfer bias in the primary transfer section located between the photosensitive drum 1*a* and the transfer roller 5*a*.

Simultaneously with the upstream image-forming operation, on the second downstream photosensitive drum 1*b*, light magenta latent images are also formed with the corona charger 2*b* as primary charging unit and the laser exposure device 3*b*. By rotating the development rotary 4*b*, the development unit 44 having light magenta toner contained therein is abutted on the downstream photosensitive drum 1*b* so as to develop the light magenta images. The light magenta images on the downstream photosensitive drum 1*b* are transferred to the intermediate transfer belt 5 by the transfer bias applied to the second downstream transfer roller 5*b*.

As the intermediate transfer belt 5 rotates in arrow B direction, the images on the intermediate transfer belt 5 pass through between the secondary transfer roller 54 separated from the intermediate transfer belt 5 and the cleaner 50 separated therefrom so as to return again to the primary transfer section.

Then, by rotating the development rotary 4*a*, the development unit 43 having yellow toner contained therein is abutted on the photosensitive drum 1*a* so as to form yellow images thereon for transferring them to the intermediate transfer belt 5. The images on the intermediate transfer belt 5 are moved to the downstream photosensitive drum 1*b* as they are so as to form cyan images thereon in the same way as in the upstream.

By repeating the above operation, magenta and black toner images are also transferred on the intermediate transfer belt 5 in the same way, so that the images in a state, in which all the colors are placed thereon, move to the secondary transfer section. In accordance with the timing at which the leading end of the full-color toner images is moved to the secondary transfer section between the roller 55 and the secondary transfer roller 54, a selected transfer material (sheet) is supplied from sheet-feed cassettes 71 to 74 via a transfer path. Then, the transfer material is conveyed to the secondary transfer section with a register roller 85. On the transfer material conveyed to the secondary transfer section, full-color toner images are secondarily transferred correctively with the secondary transfer roller 54 having secondary transfer bias applied in reverse (positive) polarity to the toner. The residual transfer toner on the intermediate transfer belt 5 is cleaned by abutting the cleaner 50 on the intermediate transfer belt 5 after the secondary transfer.

The transfer material having the full-color toner images formed thereon is conveyed to a fixing unit 9, and the toner images are heated and pressed at a fixing nip between a fixing roller and a pressing roller so as to be thermally fixed on the surface of the transfer material. Then, the transfer material is discharged on a discharge tray 89 provided on the top of the body so as to finish series of image-forming processes.

Next, the operation of the normal color mode without using light toner (when images are formed with four-color) will be described.

On the upstream photosensitive drum 1*a*, yellow latent images are formed with the corona charger 2*a* and the laser exposure device 3*a*, and by rotating the development rotary 4*a*, the yellow development unit 43 is abutted on the photosensitive drum 1*a* for developing yellow images while the light cyan development unit 41 is skipped. The yellow images on the photosensitive drum 1*a* are transferred on the intermediate transfer belt 5 by the transfer bias applied to the transfer roller 5*a*.

Simultaneously with the upstream image-forming operation, on the downstream photosensitive drum 1*b*, cyan latent images are also formed with the corona charger 2*b* as primary charging means and the laser exposure device 3*b*. By rotating the development rotary 4*b*, the cyan development unit 46 is abutted on the photosensitive drum 1*b* so as to develop cyan images while the light magenta development unit 44 is skipped. The cyan images on the photosensitive drum 1*b* are transferred to the intermediate transfer belt 5 by the transfer bias applied to the transfer roller.

As the intermediate transfer belt 5 rotates in arrow B direction, the images on the intermediate transfer belt 5 passes through between the secondary transfer roller 54 separated from the intermediate transfer belt 5 and the cleaner 50 separated therefrom so as to return again to the primary transfer section.

Then, by rotating the development rotary 4*a*, the magenta development unit 42 is abutted on the photosensitive drum 1*a* so as to form magenta images thereon for transferring them to the intermediate transfer belt 5. The images on the intermediate transfer belt 5 are moved to the photosensitive drum 1*b* as they are so as to form black images thereon in the same way as in the upstream.

By such operation, the four-color transfer has been finished, and when the images in a state, in which all the colors are placed thereon, move to the secondary transfer section, the secondary transfer roller 54 abuts the intermediate transfer belt 5 so that the images are transferred on a transfer material P by the transfer bias applied to the secondary transfer roller 54 so as to fix on the transfer material P by a fixing unit (not shown). The residual transfer toner on the intermediate transfer belt 5 is cleaned by abutting the cleaner 50 on the intermediate transfer belt 5 after the secondary transfer.

By providing the two development rotaries 4*a* and 4*b* as described above, when six-color images are formed using light toner in a so-called high-quality mode, the images can be output without reducing throughput in comparison with a conventional rotary multi-color image-forming apparatus and also without increase of the apparatus in size and cost unlike in an inline-system apparatus.

Also, when four-color images are formed without using light toner in a so-called normal mode, the images can be output at a high speed in comparison with a conventional multi-color image-forming apparatus having only one development rotary as well as without using the light toner development unit in vain.

In addition, the switching between the high-quality mode (six-color images are formed) and the normal mode (four-color images are formed) can be performed by a user in an operation unit 1508. The operation unit will be described later.

The image-forming apparatus 100 has an automatic adjustment function for adjusting the voltage of the primary charger and the primary transfer roller of the image-forming sections Sa and Sb in order to obtain high-quality images. This automatic adjustment function includes DMAX control for determining the maximum density of the image density for determining gradation of toner images and gradation correction control for achieving the gradation. The image-forming apparatus 100 also includes a patch detection sensor 53 for reading patch images formed for executing the automatic adjustment function with predetermined density and size. By the automatic adjustment function, the density of the patch images for each color is read by the patch detection sensor 53 so as to adjust the density of toner images developed by toner for each color to be optimum.

The density control using the patch detection sensor 53 is for detecting the density by forming the patch images on the intermediate transfer belt or the drum without controlling changes in color balance due to the transfer and fixing on the recording material performed thereafter. The color balance is changed by the transfer efficiency of the transfer of toner images to the recording material and heating and pressurizing of the fixing. The density control using the patch detection sensor 53 cannot correspond to these changes.

Thus, gradation patches for every single color of cyan, magenta, yellow, black, light cyan, and light magenta and the patch for color mixture of C, M, and Y are formed on the recording material, and a sensor 99 (referred to as a color sensor below) is provided for detecting the density or chromaticity of the patches on the recording material after the fixing.

In the color image-forming apparatus, the density or chromaticity of output images formed on the recording material can be controlled by feeding detected results back to the exposure amount in the image-forming section, process conditions, and a calibration table for correcting density/gradation characteristics.

Figure 2:
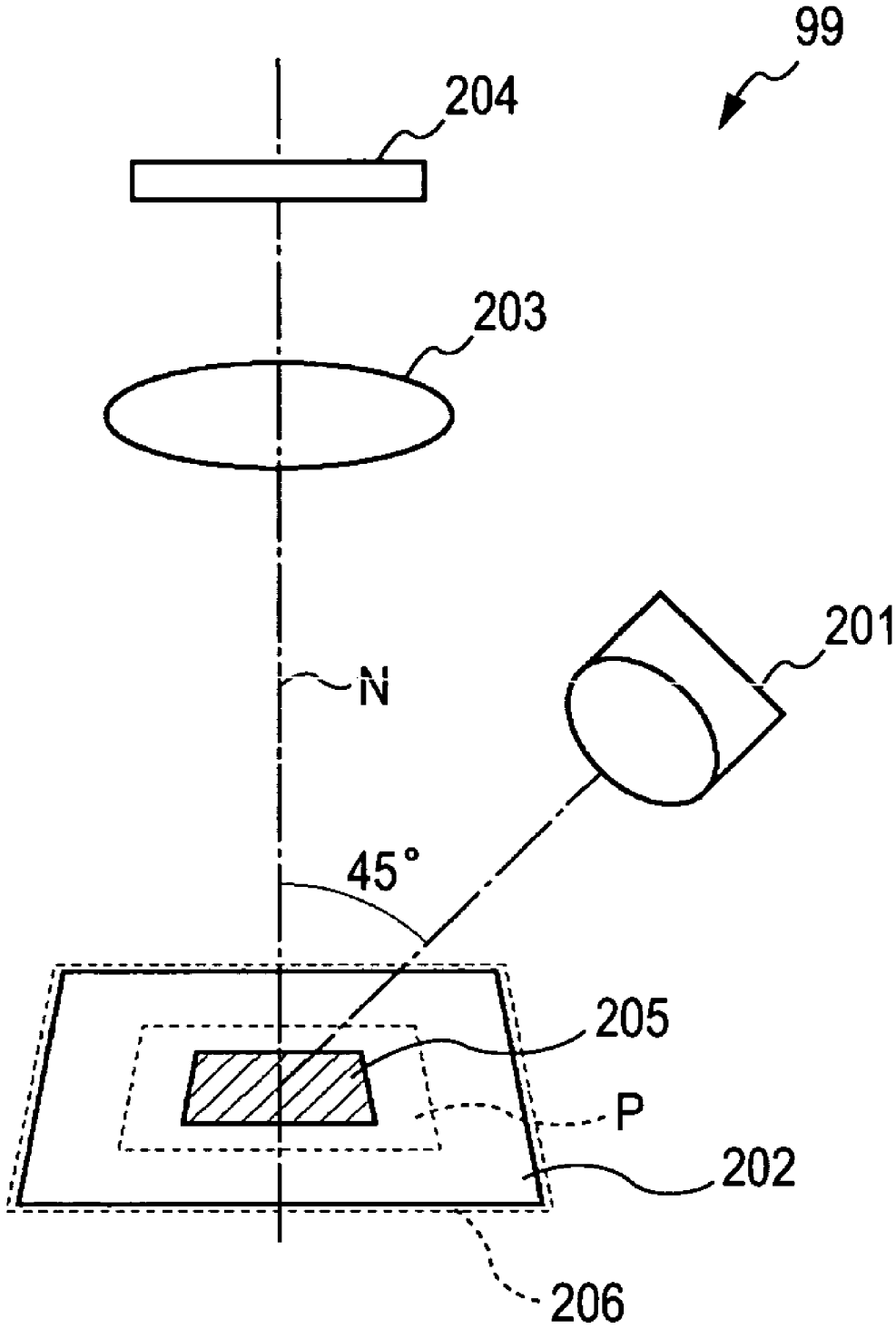
FIG. 2 is a view of the detail structure of the vicinity of a sensor after fixing.

FIG. 2 is a view of a sensor after fixing (density sensor) 99 of the color image-forming apparatus 100 shown in FIG. 1. The light source for the sensor after fixing 99 may include a light emitting diode (LED) 201 having an emission peak wavelength range of 400 nm to 700 nm determined corresponding to the color of an object pattern. The LED 201 is inclined at an angle of 45° to the normal N of a measurement opening 202, and radiates light on a pattern 205 formed on the recording sheet P conveyed to the measurement opening 202. On the normal N of the measurement opening 202, a focusing lens 203 and a light receiving unit 204 are arranged. The light irradiated from the LED 201 is reflected by the pattern 205 on the recording sheet P, and the component in the normal N direction of the reflected light is focused on the light receiving surface of the light receiving unit 204 by the focusing lens 203. The light receiving unit 204 is constructed by arranging photoelectric conversion elements such photodiodes. Between the sensor after fixing 99 and the recording sheet P, a glass 206 is arranged so that the recording sheet P is conveyed in contact with the glass 206, and the measurement is made under the condition that the light path length for the recording sheet P is constant.

Between the fixing unit 9 and the discharge tray 89, the two density sensors 99 are juxtaposed in a direction perpendicular to the conveying direction of the recording sheet so that patterns of cyan, magenta, yellow, and black fixed on the recording sheet P in the fixing unit 9 can be measured simultaneously according to demand. In addition, the two density sensors 99 are juxtaposed herein; alternatively, three or four sensors may be juxtaposed.

Figure 15:
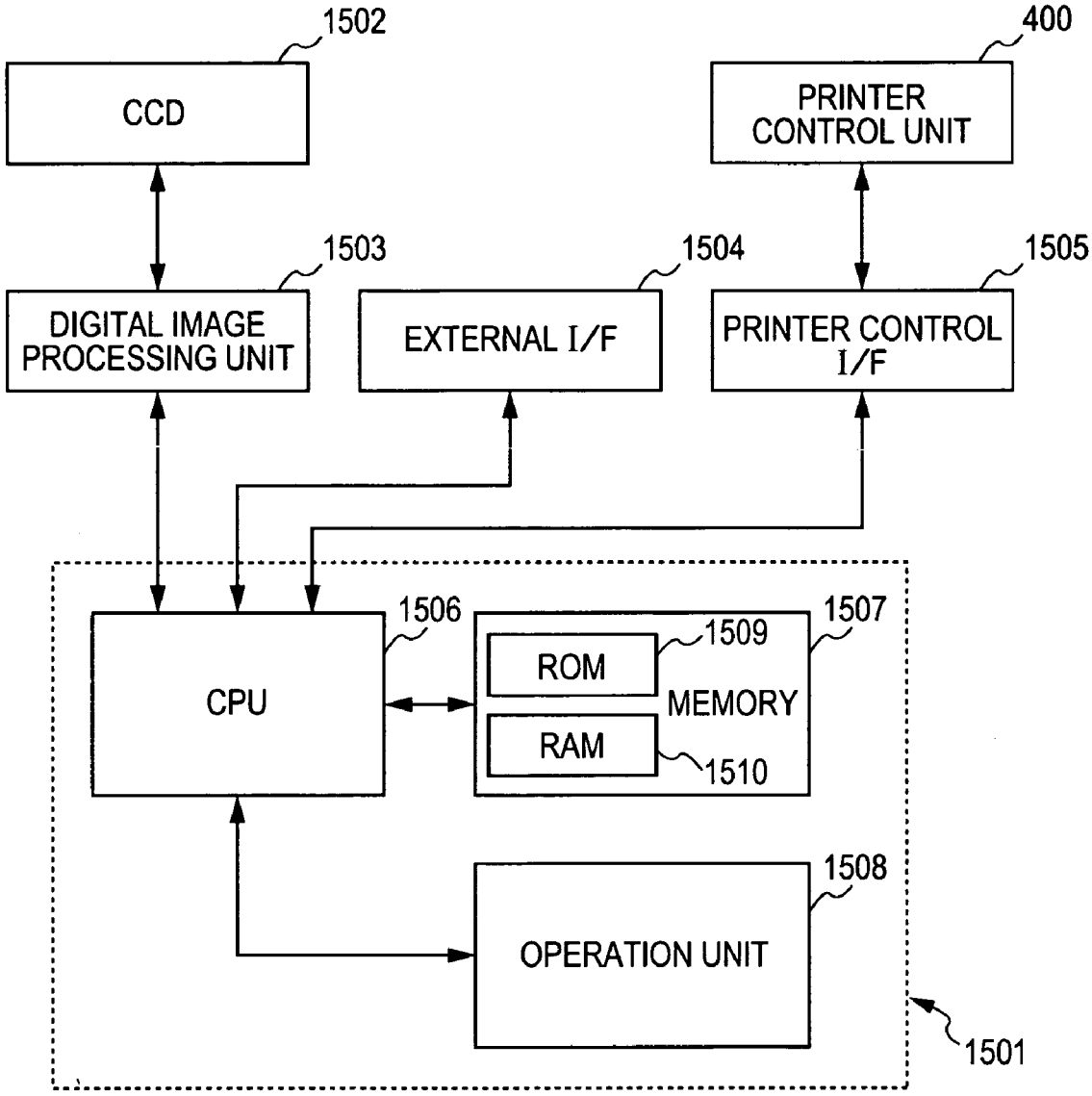
FIG. 15 is a block diagram of a control circuit.

FIG. 15 is a block diagram of essential parts of a control unit 1501 for controlling the operation of the image-forming apparatus 100. The control unit 1501 includes a central processing unit (CPU) 1506 having an interface (I/F) for exchanging information for controlling a printer control I/F 1505, an external I/F 1504, and a digital image processing unit 1503. The digital image processing unit communicates with a charge-coupled device (CCD) 1502. The printer control I/F 1505 communicates with a printer control unit 400. The control unit 1501 also includes an operation unit 1508, and a memory 1507. The memory 1507 includes a random access memory (RAM) 1510 for offering an operation region to the CPU 1506 and a read-only memory (ROM) 1509 storing control programs of the CPU 1506. The ROM 1509 stores control programs for executing operation modes such as an automatic color selecting mode (ACS) for automatically switching between the color image formation and the monochrome image formation, a high-quality color mode, a normal color mode, and a monochrome image formation mode. The ROM 1509 also stores a control program for controlling the entire image-forming apparatus 100. The operation unit 1508 is constructed of a liquid crystal display (LCD) with a touch panel for inputting contents executed by an operator and for informing the operator of information and warning about the processing.

Figure 16:
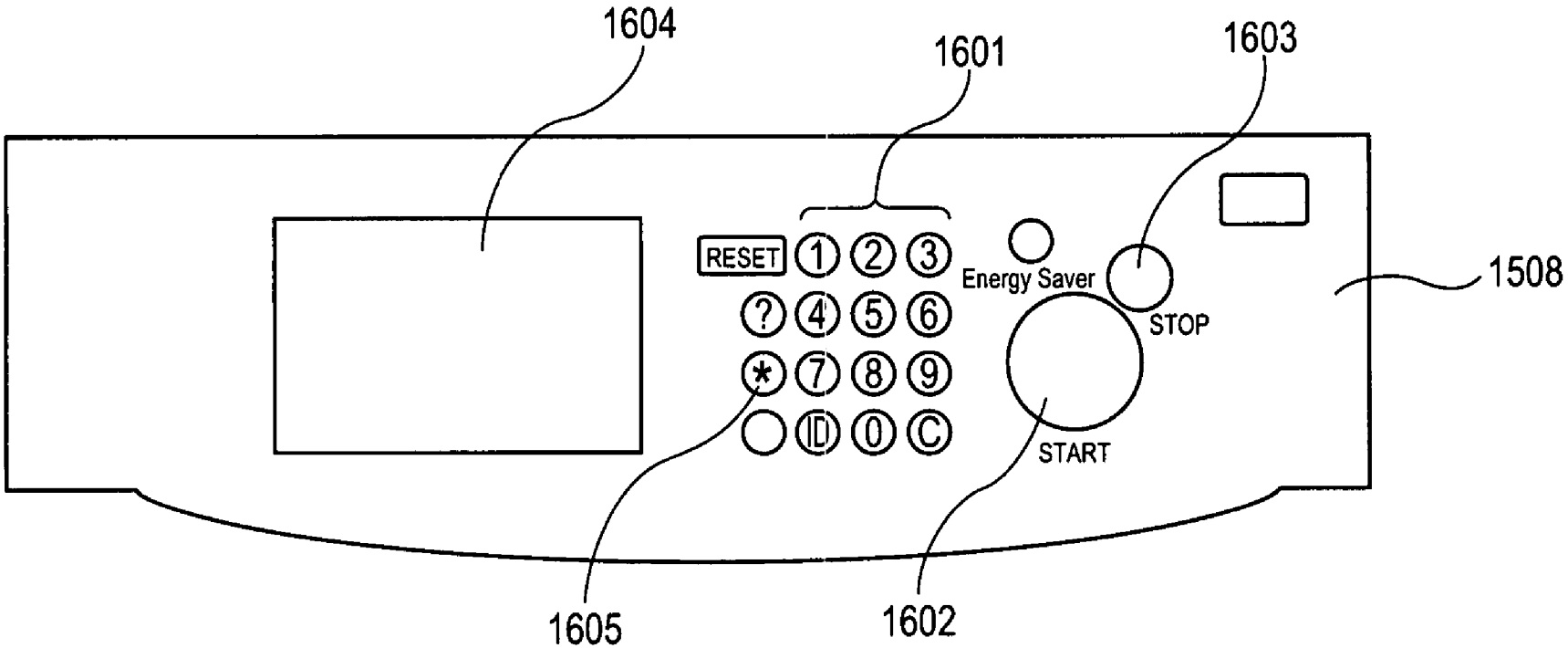
FIG. 16 is a drawing of an exemplary operation panel in the image-forming apparatus.

FIG. 16 is a drawing of an exemplary operation unit 1508. The operation unit 1508 includes aten keypad 1601, a start key 1602, a stop key 1603, an LCD 1604, and a user mode key 1605. The ten key pad 1601 is used by a user when the number of sheets to be copied is registered and the displacement of images to be copied is input. The start key 1602 is depressed by the user to start a copy job. The stop key 1603 is depressed by the user to stop the started copy job. The LCD 1604 is a display for displaying the operation state of the image-forming apparatus 100. The LCD 1604 is provided with a panel switch through which the user can set a copy job mode.

The user mode key 1605 is depressed by the user when a user mode screen is displayed on the LCD 1604. On the user mode screen, the specification can be set for functions included in the image-forming apparatus 100. For example, if any one of the high-quality color mode, the normal color mode, and the monochrome image formation mode (also referred to herein as the monochrome mode) is not explicitly specified by the user, an automatic color select (ACS) mode automatically determines images to be formed so as to switch between the color image-formation and the monochrome image-formation.

Figure 14:
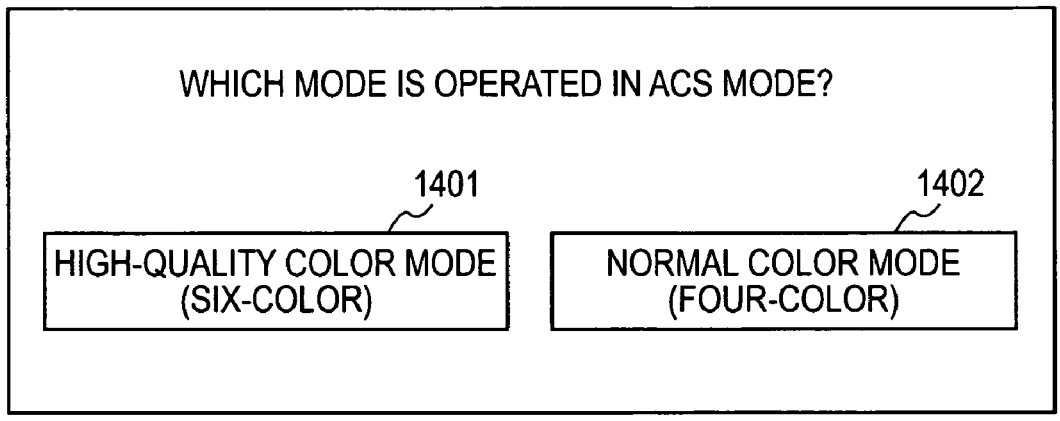
FIG. 14 is a drawing of an exemplary display screen in an ACS mode of an operation panel.

As shown in FIG. 14, when the color image-formation is switched in the ACS mode, either of the high-quality color mode or the normal color mode can be selected as a standard mode (default). That is, when the high-quality color mode is set as the standard mode (default), if a color document is placed in the ACS mode, the image-formation is automatically operated in the high-quality color mode by recognizing the document. When the normal color mode is set as the standard mode (default), if a color document is placed in the ACS mode, the image-formation is automatically operated in the normal color mode by recognizing the document.

A user can establish the standard operation of the copying machine such as the setting whether length and breadth sizes of the sheet are input if the sheet has an undefined size during monochrome image-formation; and the setting whether length and breadth sizes of the sheet are input at first or length and breadth sizes of the sheet are input when a color document is detected if the sheet has an undefined size in the automatic color select mode.

The start of the adjustment mode can be specified, in which the density or gradation of output images formed on a recording material is controlled as the feature of the present invention.

Figure 18:
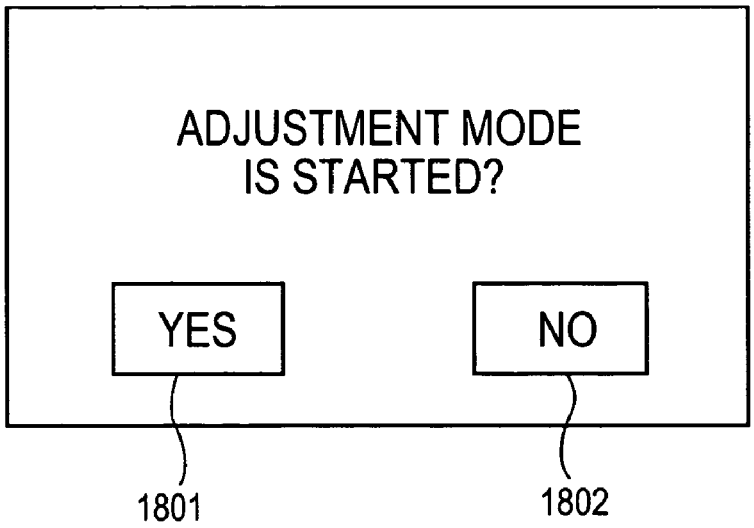
FIG. 18 is a drawing of a display screen in an adjustment mode in the operation panel.
Figure 19:
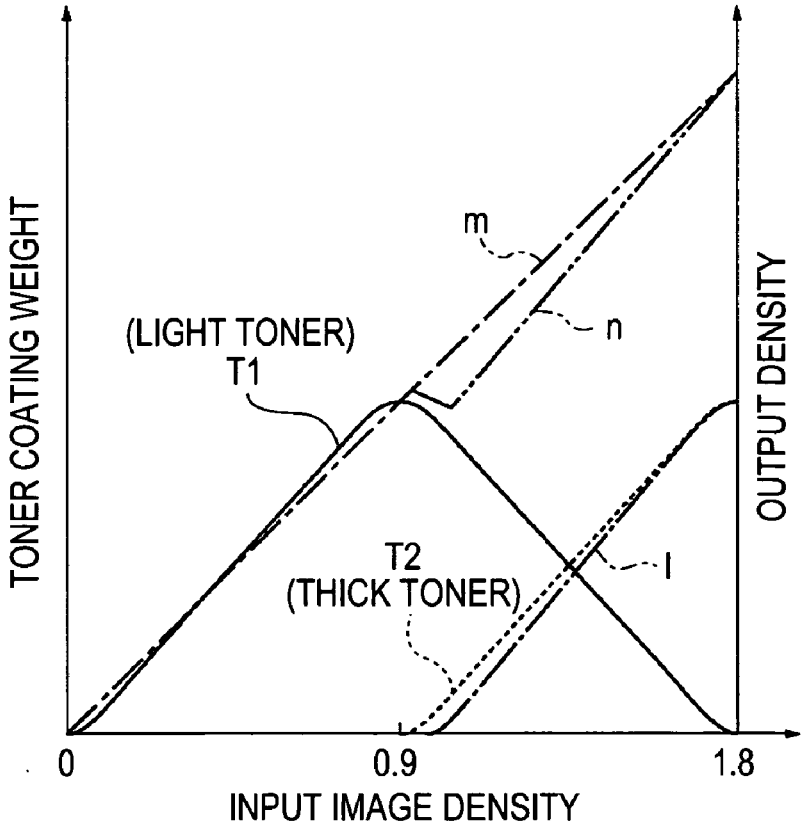
FIG. 19 is a graph showing the relationship between the image density of input image signals for dark toner and for light toner and a toner quantity consumed/output density.

FIG. 18 is a drawing of the display screen in the adjustment mode in the LCD 1604. This screen is displayed when the adjustment mode is selected by depressing the user mode key 1605 so as to display the user mode screen on the LCD 1604. If YES button 1801 is selected, the adjustment mode is started and if NO button 1802 is selected, the screen is returned to the user mode screen.

Figure 17:
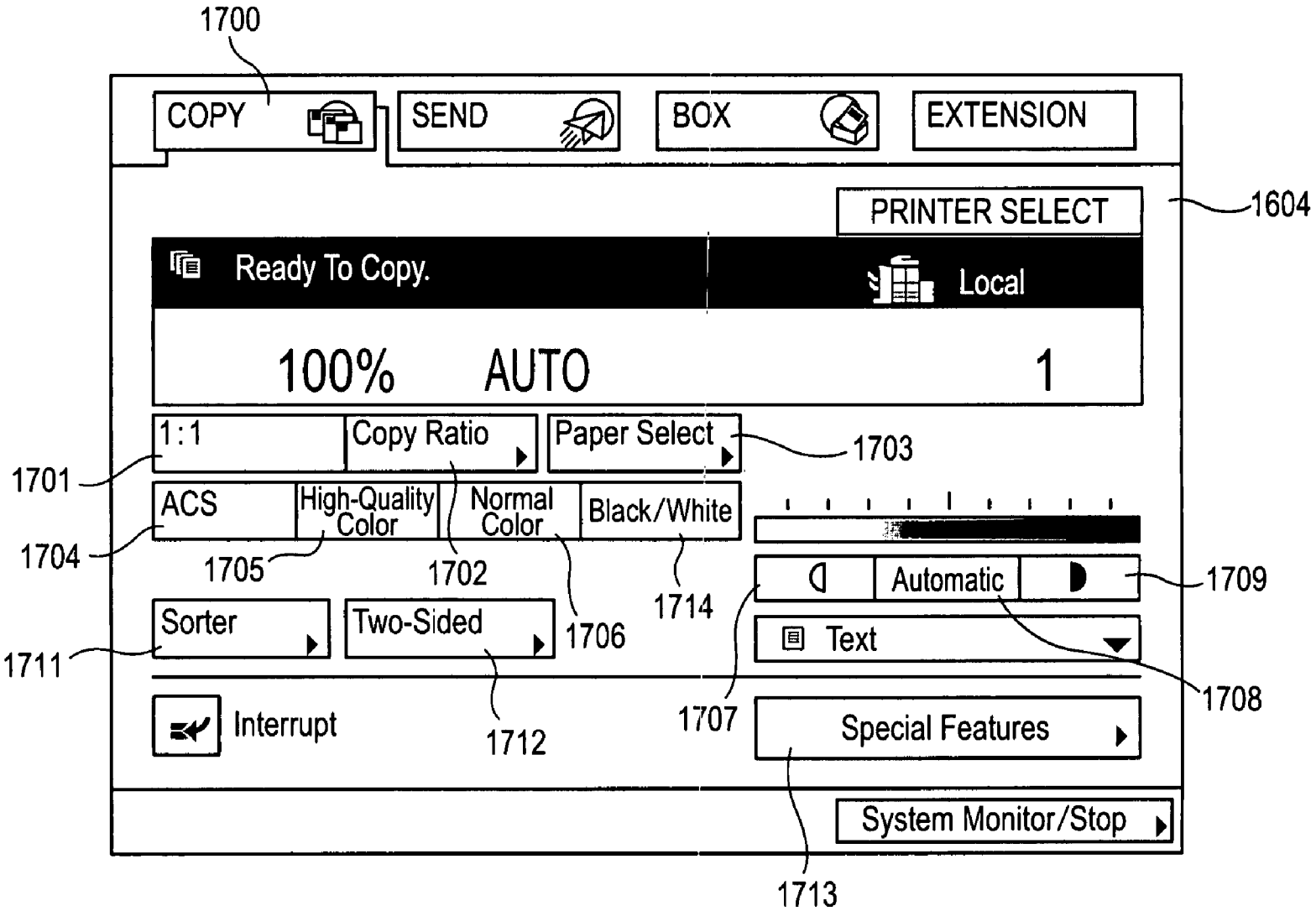
FIG. 17 is a drawing of a display screen in a normal state in the operation panel.

FIG. 17 is a drawing of the display screen in the standard state in the LCD 1604. On a screen 1700, reference numerals 1701 and 1702 denote buttons for setting the magnification during image formation. Numeral 1703 denotes a sheet select button for specifying the sheet size such as various defined sizes and undefined sizes. The display screen includes an automatic color select (ACS) button 1704 for selecting the ACS mode, a high quality color button 1705 for selecting the high-quality color mode, a normal color button 1706 for selecting the normal color mode, and a black/white button 1714 for selecting the monochrome image forming mode. Of these four buttons, only one button is exclusively selected, i.e., two or more buttons cannot be simultaneously selected. The display screen also includes buttons for adjusting printing density of the images 1707, 1708, 1709. A sorter button 1711 is used for specifying the processing such as the staple performed for a recording sheet bundle in a discharged sheet processing device (not shown). A two-sided button 1712 is used for specifying any format of the image arrangement including single-sided to single sided, single-sided to double-sided, double-sided to single-sided, and double-sided to double-sided when the document images are formed on a recording material. A special features button 1713 is used for specifying any of various application modes.

Figure 3:
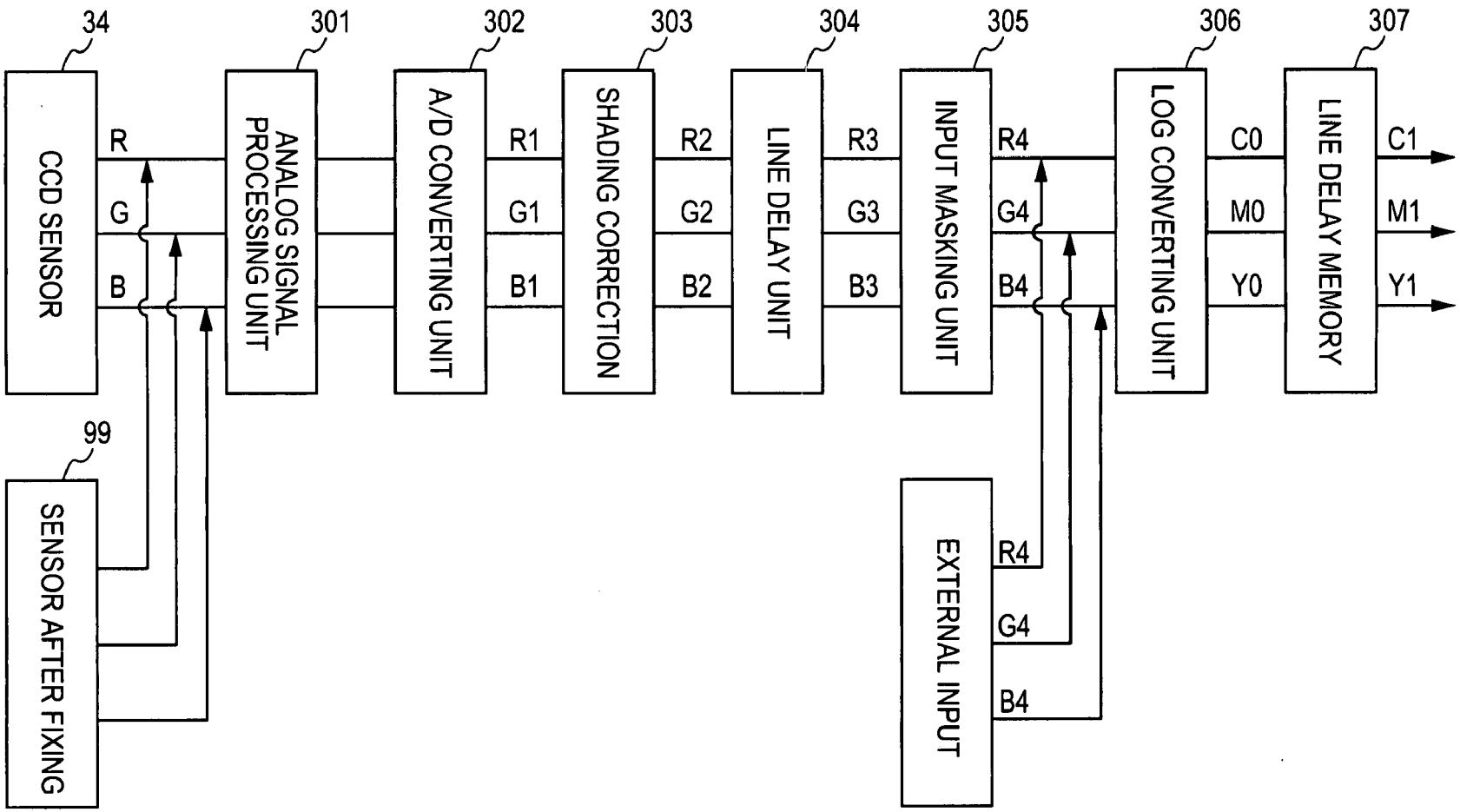
FIG. 3 is a block diagram showing the flow of an image signal of the image processing unit in a reader unit.

FIG. 3 is a block diagram showing the flow of an image signal of the image processing unit in the reader unit 300 of the image-forming apparatus 100 shown in FIG. 1.

Image signal output from a CCD sensor 34 of the reader unit 300 and output signals from the post-fixing sensor 99 are input into an analog signal processing unit 301 so as to be adjusted in gain and offset. In an analog-to-digital (A/D) converting unit 302, image signals for each color are converted into 8-bit digital image signals R1, G1, and B1. Then, the image signals are input into a shading correction unit 303 so that the known shading correction using the reading signal of a reference white plate is made for each color.

Since line sensors of the CCD sensor 34 are spaced from each other at predetermined intervals, the spatial displacement in an auxiliary scanning direction needs to be corrected in a line delay unit 304. An input masking unit 305 is for converting a reading color space determined by spectral characteristics of filters R (red), G (green), and B (blue) of the CCD sensor 34 into an NTSC (national television system committee) standard color space by the matrix computation of 3×3. A LOG converting unit 306, which is a light quantity/density conversion unit, is composed of lookup table (LUT) RAMs for converting luminance signals R4, G4, and B4 into density signals. Then, the image signals cyan C0, magenta M0, and yellow Y0 output from the LOG converting unit 306 are supplied to a line delay memory 307, and then to a printer control unit 400 shown in FIG. 4 as image signals C1, M1, and Y1. Character C denotes a cyan image signal; character M denotes a magenta image signal; character Y denotes a yellow image signal; and character Bk denotes a black image signal herein. Image signals R4, G4, and B4 from an external input shown in the drawing designate the image signals from a computer or a facsimile.

Figure 4:
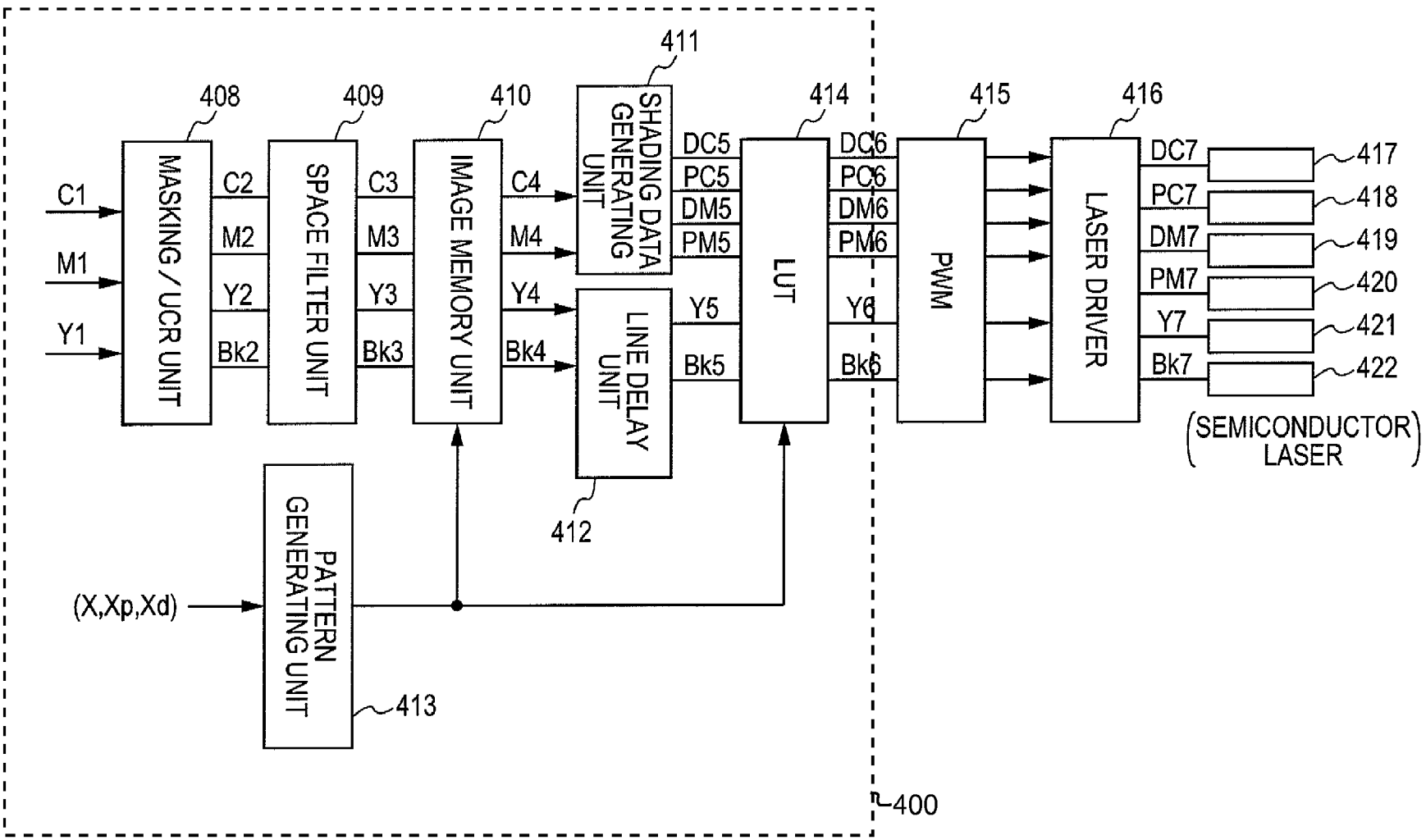
FIG. 4 is a block diagram showing the flow of an image signal in a printer control unit.

FIG. 4 is a block diagram showing the flow of an image signal in a printer control unit 400 for controlling the image-forming apparatus 100 shown in FIG. 1.

A masking and under color removal (UCR) unit 408 extracts a black signal (Bk) from input of three primary colors Y1, M1, and C1. Furthermore, the color turbidity of a record coloring material generated in the image-forming apparatus 100 is corrected by computation so as to sequentially output signals Y2, M2, C2, and Bk2 every reading operation with a predetermined bit width (8 bit).

A space filter unit (output filter) 409 emphasizes or smoothes edges. An image memory unit 410 stores the signals Y2, M2, C2, and Bk2 output from the space filter unit 409 after being processed as described above so as to feed them to a shading data generating unit 411 and a line delay unit 412 synchronous with the image-forming operation.

The shading data generating unit 411 has a function to convert input image signals C4 and M4 into cyan and magenta image signals for dark toner DC5 and DM5 and cyan and magenta image signals for light toner PC5 and PM5, respectively. This converting process is made using a predetermined conversion table. The configuration of this predetermined conversion table is changed correspondingly to whether the input images are half-tone or characters. That is, the ratio between image data for dark toner and image data for light toner is changed such that for the half-tone images, the amount of the light toner is increased so as to reduce the roughness in a highlight portion while for character images, the amount of the dark toner is increased so as to limit the toner coating weight.

The line delay unit 412 corrects the displacement of Y4 and Bk4 relative to DC5, PC5, DM5, and PM5 produced by data conversion in the shading data generating unit 411 for synchronizing six-color image data to be input in an LUT 414 (below mentioned). The LUT 414 has γ table for light toner and γ table for dark toner for density correcting (gradation correcting) the density so as to have ideal gradation characteristics of the image-forming apparatus 100. The six-color image data (DC5, PC5, DM5, PM5, Y5, and Bk5) output from the shading data generating unit 411 and the line delay unit 412 are supplied to the LUT 414 so as to have gradation correction.

The signals (DC6, PC6, DM6, PM6, Y6, and Bk6) output from the LUT 414 are sequentially fed to a pulse width modulation (PWM) unit 415 where a laser driver 416 drives a semiconductor laser for each color and light color 417 to 422 (corresponding to semiconductor laser 36 shown in FIG. 1) so as to form latent images on the photosensitive drums 1*a* and 1*b*.

Figure 5:
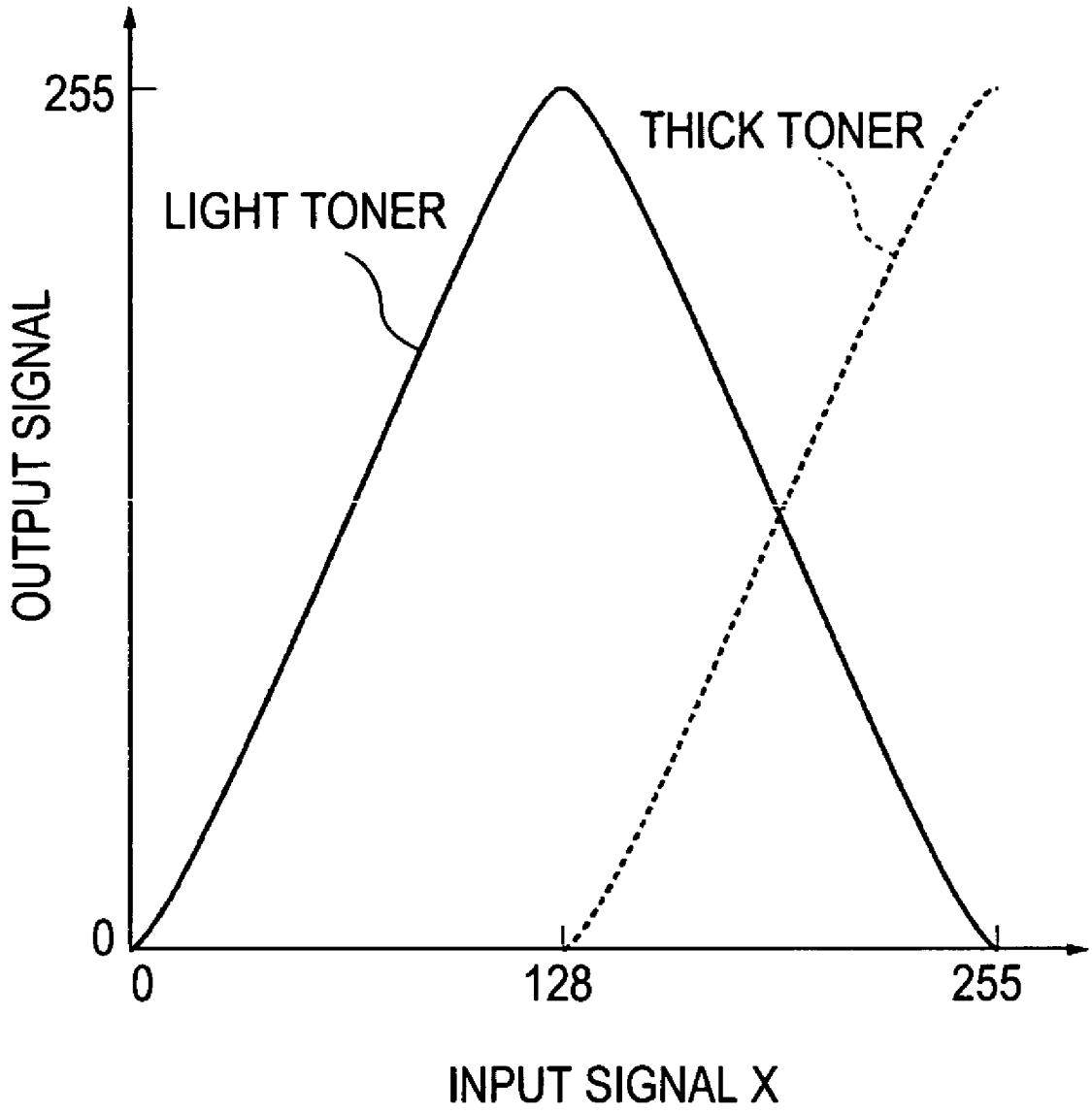
FIG. 5 is a graph showing output characteristics of the shading data generated in a shading data generating unit.

FIG. 5 is a graph showing output characteristics of the shading data (an image signal for dark toner and an image signal for light toner) generated in the shading data generating unit 411. The graph shows the relationship between input signals X (0 it 255) (for thick and light toner) to be input into the shading data generating unit 411 and output signals output from the shading data generating unit 411 at this time. In the range of 0 to 128 of the input signals X, images are formed of only light toner, and in the range of 128 to 255, the images are formed of both dark toner and the light toner by reducing the light toner while gradually adding the dark toner.

In such a manner, from the input signals X=0 to 128, the output signals 0 to 255 are output with only light toner and from the input signals X=128 to 255, the output signals 0 to 255 are output with both the light toner and dark toner. In the input signal X=128, the input value of the light toner is 255 which is identical to the output value thereof while the input value of the dark toner is 0 which is identical to the output value thereof.

The image-forming apparatus according to the exemplary embodiment is provided with a pattern generating unit 413 arranged therein. The pattern generating unit 413 registers a test pattern 7A-0 (see FIG. 7) for outputting a four-color test print 7A used in an adjustment mode according to the present invention without using light toner and patch patterns 11B-1 and 11B-2 (see FIG. 11) for outputting a four-color test print 11B. The pattern generating unit 413 also registers a test pattern 12A-0 (see FIG. 12) for outputting a six-color test print using the dark toner and light toner and patch patterns 13B-1 and 13B-2 (see FIG. 13) for outputting a six-color test print 13B.

The pattern data output from the pattern generating unit 413 can be supplied to the shading data generating unit 411 and the line delay unit 412 via the image memory unit 410 or directly supplied to the PWM unit 415 via the LUT 414. Thus, the printer control unit 400 shown in FIG. 4 can output both the pattern data converted in the shading data generating unit 411 and the LUT 414 and the pattern data not converted in the shading data generating unit 411 and the LUT 414.

The image signals DC6, PC6, DM6, PM6, Y6, and Bk6 output from the LUT 414 by being processed in such a manner are fed to the PWM unit 415, and are converted into laser light by semiconductor laser beams 417 to 422 via the laser driver 416.

Characteristic Processing According to the Exemplary Embodiment

The processing of density correction and gradation correction made in an adjustment mode of the color image-forming apparatus constructed as described above will be described with reference to FIGS. 4 to 11.

Figure 6:
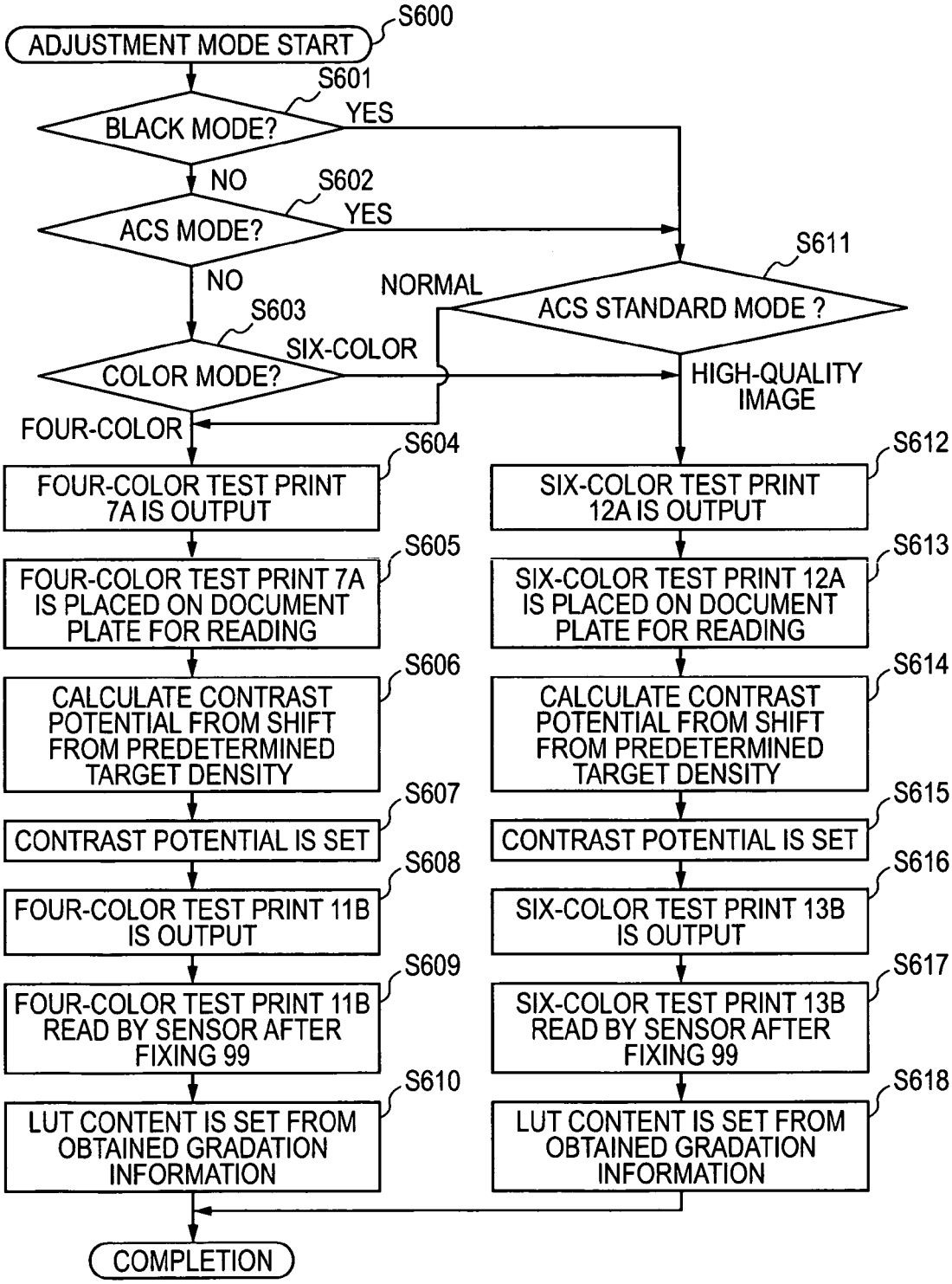
FIG. 6 is a flowchart of an adjustment mode.

FIG. 6 is a flowchart showing the processing of density correction and gradation correction in the adjustment mode according to the exemplary embodiment.

The CPU 1506 controlling the full-color image-forming apparatus according to the embodiment as a whole executes the adjustment mode at the time when the start of the adjustment mode is instructed by a user. The adjustment mode can be performed at an arbitrary timing selected by the user such as prior to the image formation, during the image forming, and after the image formation.

The control unit 1501 detects the operation mode selected in the LCD 1604 (Steps S601 to S603, and S611) when the start of the adjustment mode is instructed by a user (Step S600).

That is, the control unit 1501 detects any selected one of modes of the automatic color select (ACS) mode, the high-quality color mode, the normal color mode, and the monochrome image forming mode.

When the normal color mode is selected and when the normal color mode is selected as default in the automatic color select (ACS) mode, the adjustment is made in a four-color mode. Also, when the high-quality color mode is selected as default in the high-quality color mode and the automatic color select (ACS) mode, the adjustment is made in a six-color mode. When the monochrome image formation mode is selected, if the start of the adjustment mode is instructed, the adjustment is made in any one of the high-quality color mode and the normal color mode, which are established as the standard of the automatic color select (ACS) mode.

Specifically, at Step S601, it is determined whether the present mode is monochrome image formation mode or not. At Step S602, it is determined whether the present mode is the automatic color select (ACS) mode or not. At Step S603, it is determined whether the present mode is the high-quality color mode or the normal color mode. At Step S611, when the present mode is the automatic color select (ACS) mode, the standard mode is determined whether the high-quality color mode or the normal color mode.

A color mode, in which adjustment is made, is switched to another color mode with the buttons 1704, 1705, 1706, and 1714, and the adjustment mode is to be performed. That is, when the normal color mode is selected as default in the normal color mode or the ACS mode, a color mode, in which adjustment is made, is switched to the high-quality color mode as default in the high-quality color mode or the ACS mode. Also, when the high-quality color mode is selected as default in the high-quality color mode or the ACS mode, a color mode, in which adjustment is made, is switched to the normal color mode as default in the normal color mode or the ACS mode. The adjustment at this time may be automatically made when the color mode is switched or may be selected by a user by displaying the screen shown in FIG. 18 on the display. However, the adjustment made at this time is the adjusting operation corresponding to the color mode after the switching. That is, when a color mode is switched to the six-color mode, the adjustment is made in the six-color mode, and when being switched to the four-color mode, the adjustment is made in the four-color mode.

Adjustment in Four-color Mode

I. Density Correction in Four-color Mode

Figure 7:
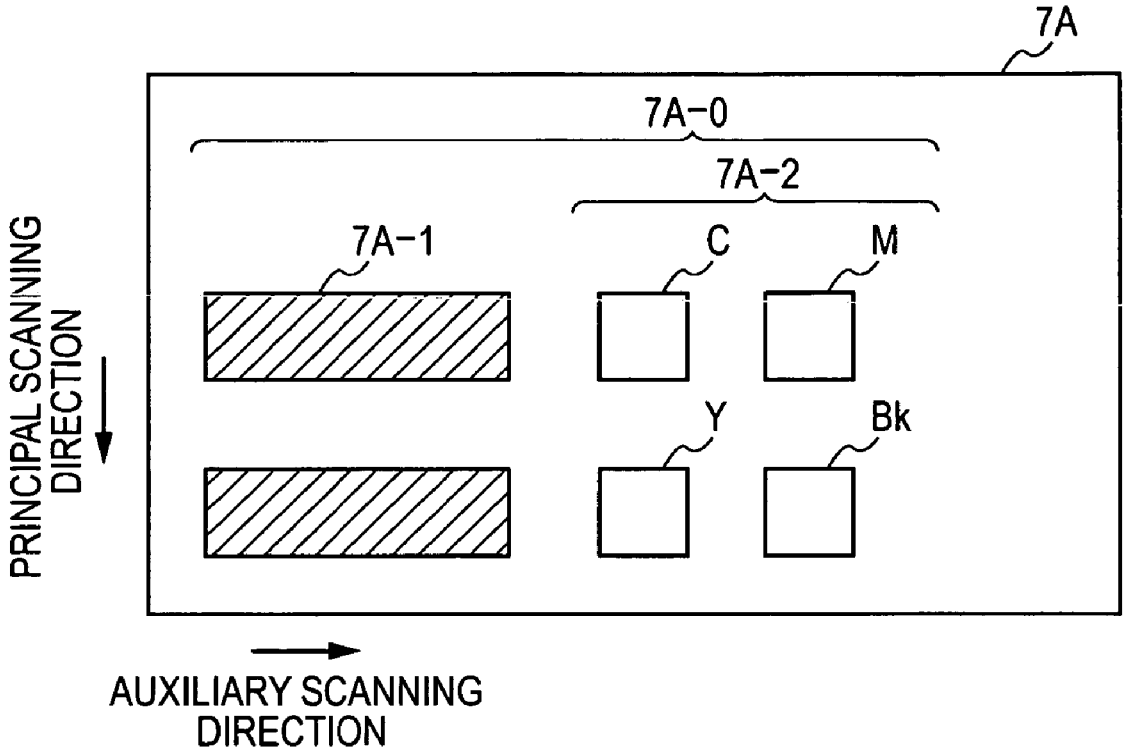
FIG. 7 illustrates a patch pattern used in gradation correction processing.

FIG. 7 illustrates a four-color test print 7A used in density correction in a four-color mode. When a user performs the adjustment in the four-color mode (Step S604), the four-color test print 7A having a test pattern 7A-0 shown in FIG. 7 formed thereon is output (Step S605). The test pattern 7A-0 is formed of a band pattern 7A-1 composed of halftone densities for four colors Y (yellow), M (magenta), C (cyan), and Bk (black); and a patch pattern 7A-2 composed of maximum density patches for colors Y, M, C, and Bk (density signal 255 levels). A contrast potential (described below) during the image forming of the four-color test print 7A has a standard initial value registered therein according to an environment.

At Step S605 in succession, the output four-color test print 7A is read by the sensor after fixing 99 (may also be read by the reader unit 300 by placing it on a document glass plate 31), and the obtained RGB values are converted into optical densities using the LUT 414. Then, a method for setting the contrast potential by correcting the maximum density from density information obtained through the LUT 414 (Step S606 and Step S607) will be described with reference to FIGS. 8 and 9.

Figure 8:
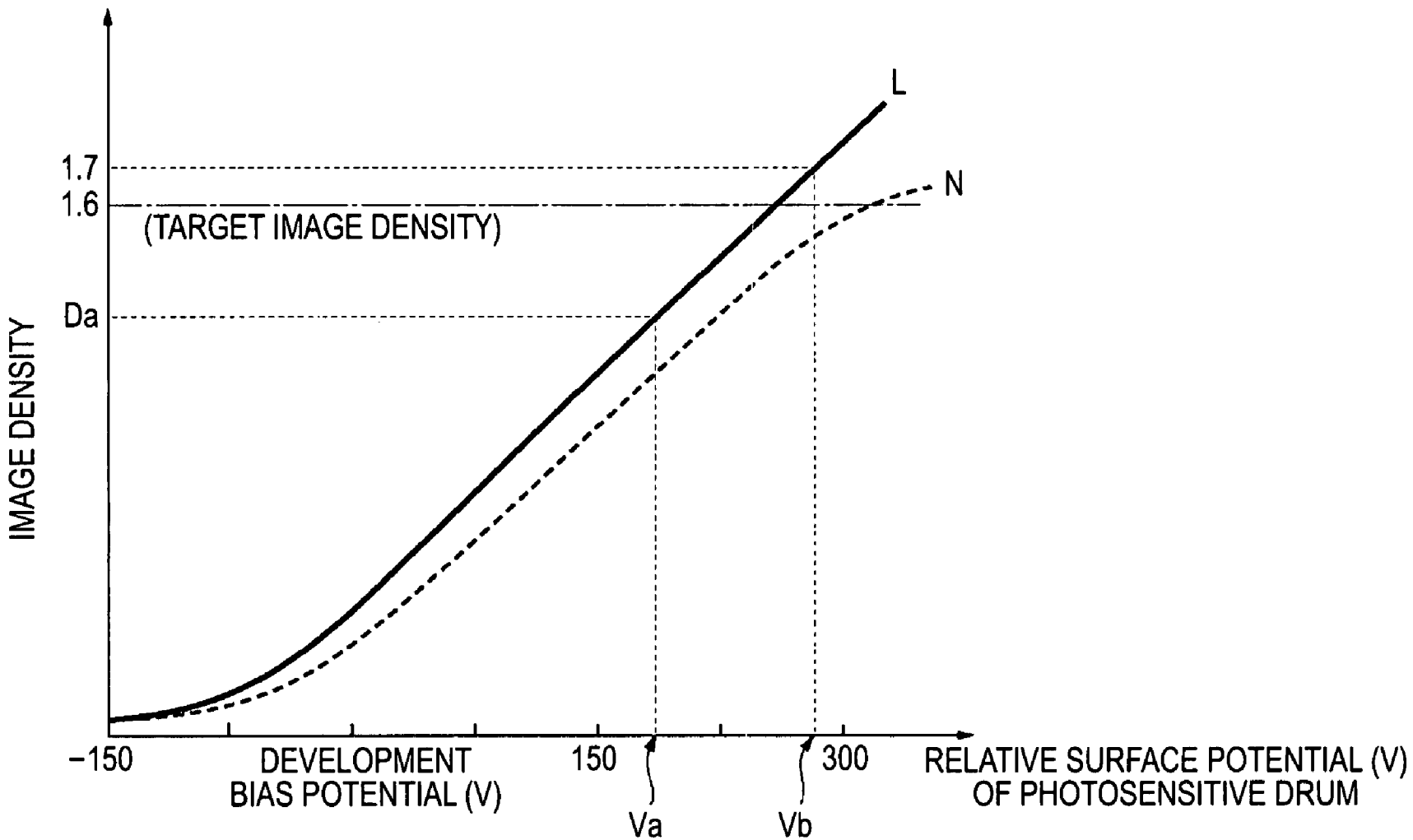
FIG. 8 is a graph showing the relationship between the image density and the relative surface potential of a photosensitive drum.

FIG. 8 is a graph showing the relationship between the image density and the relative surface potential of a photosensitive drum (the surface potential of the photosensitive drum using a development bias potential as a reference). When the maximum density is Da, which is obtained by setting up the contrast potential used at a time to be Va, that is, the difference between the surface potential of the photosensitive drum when semiconductor laser beams 417 to 422 for each color are emitted at the maximum level after being temporarily charged and the development bias potential is Va, the image density may linearly correspond to the relative surface potential of the photosensitive drum in the maximum density region as shown by the solid line L of FIG. 8. However, when the development efficiency is reduced due to toner degradation, the characteristics may become non linear in the maximum density region as shown by the broken line N of FIG. 8. Hence, the final target maximum density is to be 1.6; however, the target maximum density herein is set to be 1.7 by allowing for a margin of 0.1 so as to determine the controlled variable. The contrast potential Vb herein is obtained using the following equation (1).

$$Vb=(Va+ka)\times 1.7/Da \quad (1)$$

where ka is a correction coefficient, and it is preferable to optimize this value by the kind of the developing system.

In such a manner, the contrast potential Vb is calculated (Step S606 of FIG. 6).

Next, a method for obtaining the grid potential controlling the charging amount on the photosensitive drum and the development bias potential from the contrast potential Vb will be described with reference to FIG. 9.

Figure 9:
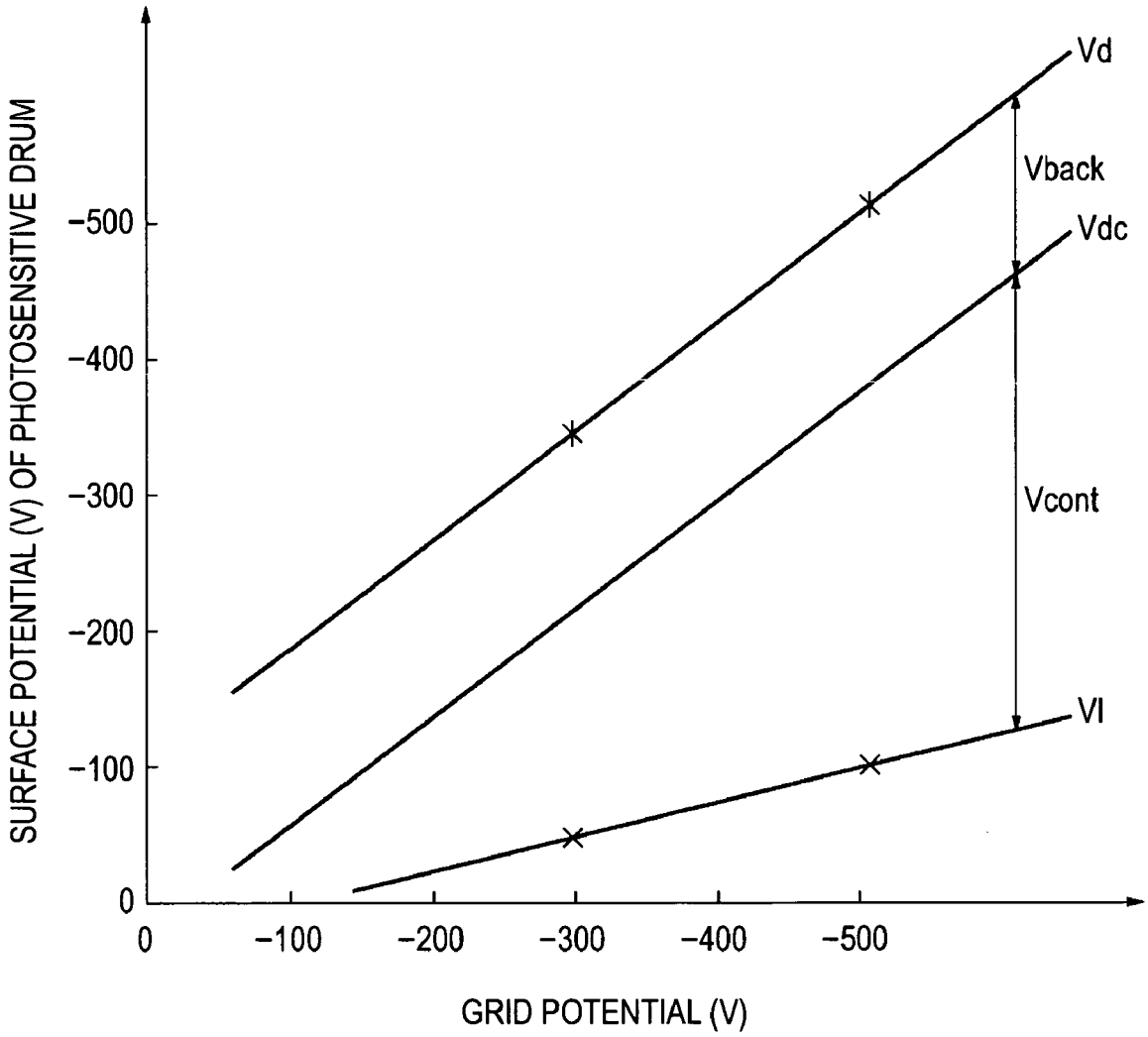
FIG. 9 is a graph showing an example of the relationship between the surface potential of the photosensitive drum and the grid potential.

FIG. 9 is a graph showing an example of the relationship between the surface potential of the photosensitive drum and the grid potential. The surface potential Vd when the grid potential is set to be −300 V and the semiconductor laser is applied at the minimum pulse level and the surface potential Vl when the semiconductor laser is applied at the maximum pulse level are measured with a surface potential electrometer. Similarly, the surface potentials Vd and Vl when the grid potential is set to be −500 V are measured. By interpolating and extrapolating the data when the grid potential=−300 V and the data when the grid potential=−500 V, the relationship between the surface potential of the photosensitive drum and the grid potential can be obtained.

The development bias Vdc is set by subtracting the potential Vback (set at 150 V herein) from the surface potential Vd. The potential Vback is set for preventing fogging toner from adhering on the images. The fogging toner means adhesive toner that may adhere to portions on the photosensitive drum where toner should not originally adhere because of insufficiently charged conditions. The contrast potential Vcont is a difference voltage between the development bias Vdc and the surface potential Vl, and with increasing Vcont, the maximum density becomes large.

The grid potential for setting the potential at the calculated contrast potential Vb and the development bias potential can be obtained from the relationship shown in FIG. 9. The contrast potential herein is obtained so that the maximum density is larger than the final target value by 0.1, and the grid potential and the development bias potential are established so as to have this contrast potential (Step S607 of FIG. 6).

II. Gradation Correction in Four-color Mode

The overall gradation characteristics in the image-forming apparatus according to the embodiment will be described at first with reference to FIG. 10.

Figure 10:
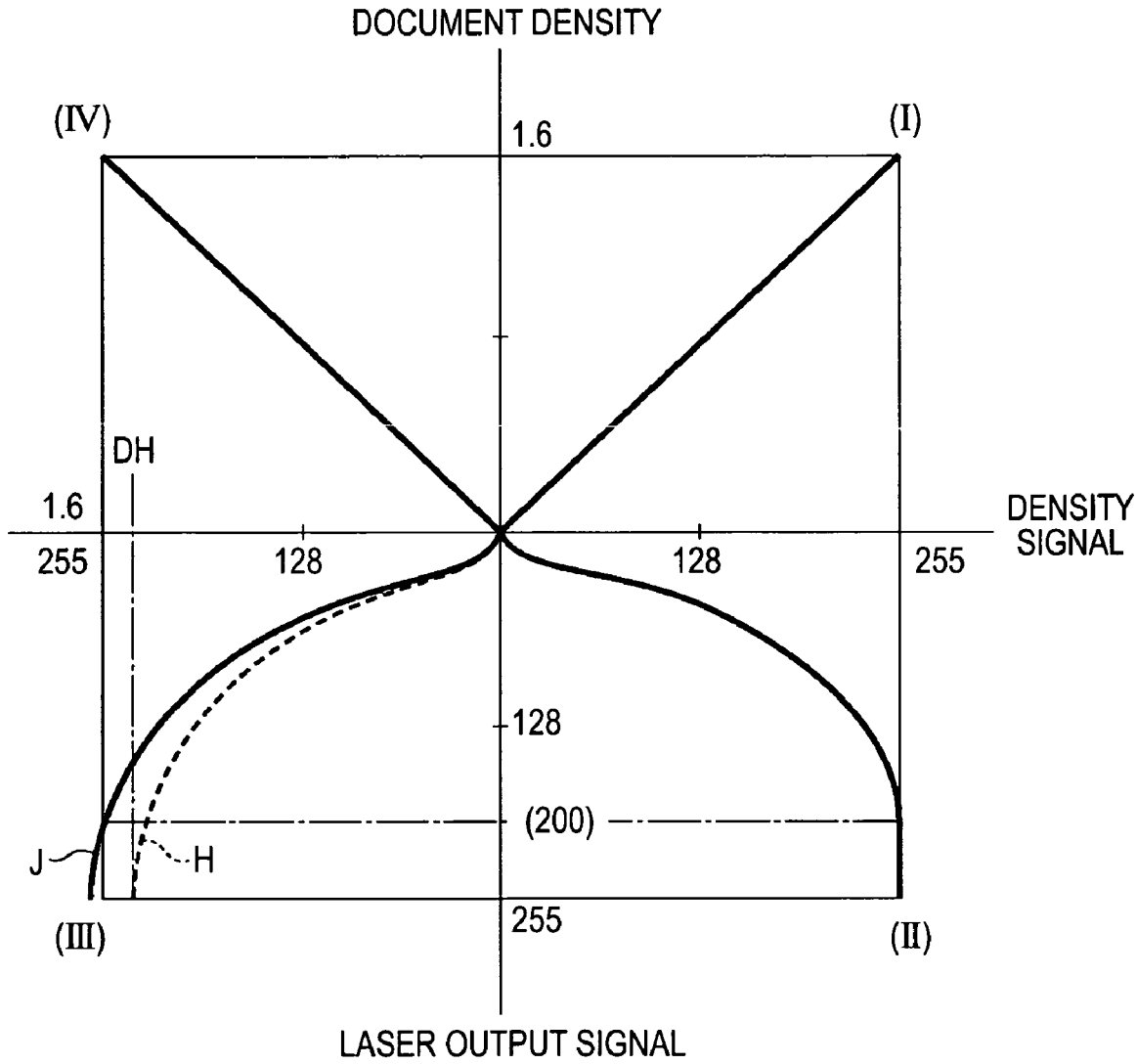
FIG. 10 is a characteristic conversion diagram during gradation correction.

FIG. 10 is a characteristic conversion diagram during gradation correction according to the embodiment. In the drawing, a first quadrant I shows characteristics of a density reading member (the CCD sensor 34, the density sensor 99) for converting document density into a density signal; a second quadrant II shows characteristics of the LUT 414 for converting the density signal into a laser output signal; a third quadrant III shows recording characteristics of a printer for converting the laser output signal into output density; and a fourth quadrant IV shows the relationship between the document density and the recorded density. The characteristics shown in FIG. 10 show the overall gradation characteristics in the image-forming apparatus according to the exemplary embodiment. According to the embodiment, the number of gradient levels is 256 because of the processing with 8-bit digital signals.

By the above-mentioned maximum density correction control setting the maximum density at a level higher than the final target value, the printer characteristics shown in the third quadrant III become solid line J. If such control were not executed, the printer characteristics would become like broken line H that cannot arrive at the target density 1.6. In this case, regardless of the setting of the LUT 414, the densities between density DH and 1.6 cannot be reproduced because the LUT 414 has no function to raise the maximum density.

In the image-forming apparatus according to the embodiment, in order to make the gradation characteristics shown in the fourth quadrant IV linear, the curved portion of the recording characteristics of the third quadrant III are corrected through the characteristics of the LUT 414 in the second quadrant II. The LUT 414 can be easily prepared by counterchanging the input/output relationship of the characteristics in the third quadrant III.

Figure 11:
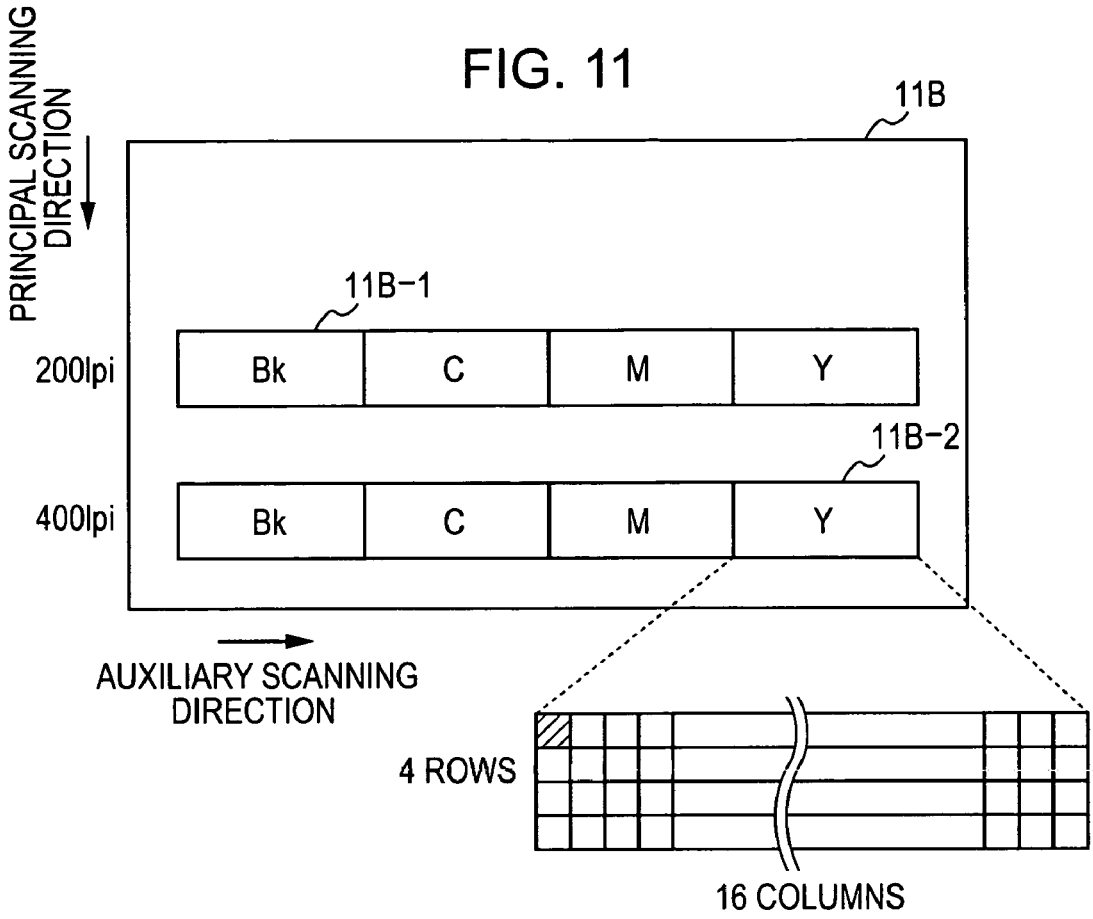
FIG. 11 illustrates a patch pattern used in density correction processing.

In the gradation correction in the four-color mode, first, the color test print 11B shown in FIG. 11 is output (Step S608 of FIG. 6) and is read (Step S609). When the color test print 11B is output, images are formed without operating the LUT 414. This is because if the images were formed by operating the LUT 414, the patch corrected in gradation would be output, so that there is no point in reading the output color test print 11B.

FIG. 11 illustrates the four-color test print 11B used in gradation correction processing in the four-color mode. As shown in the drawing, the four-color test print 11B is prepared with the patches 11B-1 and 11B-2 for colors Y, M, C, and Bk with the gradation of 4 rows×16 columns and 64 gradient levels in total. The 64-gradient level patches 11B-1 and 11B-2 among 256 levels in total are allocated in the low-density region with emphasis thereon. By doing so, the gradation characteristics in highlighted portions can be adjusted.

The patch 11B-1 has a resolution of 200 lpi (line/inch) and the patch 11B-2 has a resolution of 400 lpi. In order to form the patches 11B-1 and 11B-2 having respective resolutions, in pulse-width modulation units 415 for each color, a plurality of cycles of pyramidal waves used for comparison with processing object image data may be prepared. In the image-forming apparatus, gray-scale images are formed at 200 lpi and line images such as characters at 400 lpi. At the two resolutions, a pattern with the same gradient level is output; however, if the gradation characteristics largely differ due to the difference of the resolution, the above-mentioned gradient level may be preferably established according to the resolution. Then, a four-color test print 11B output is placed on the document glass plate 31 and is read with the reader unit 300, and the obtained RGB values are converted into optical densities using the LUT 414 (Step S609 of FIG. 6). Using the density information obtained in such a manner, through the same procedure as that of the maximum density control, the contrast potential is calculated so as to establish it. Furthermore, the density value is read and corrected by the fixing sensor 99 or the reader unit 300 so that the relationship between the density and a laser output level is stored in a memory by making the laser output level correspond to the formation positions of the patches 11B-1 and 11B-2. In this stage, the printer characteristics shown in the third quadrant III of FIG. 10 can be obtained, so that the content of the LUT 414 is calculated by interchanging the input/output relationship of the printer characteristics so as to establish the LUT 414 (Step S610 of FIG. 6).

When the content of the LUT 414 is calculated, it is necessary that the laser output level can correspond to the density signal level over the entire levels 0 to 255 of the density signal; however, since the number of gradient patterns of the patches 11B-1 and 11B-2 is the only data, the insufficient data therebetween may be complemented.

III. Density Correction in Six-color Mode

Figure 12:
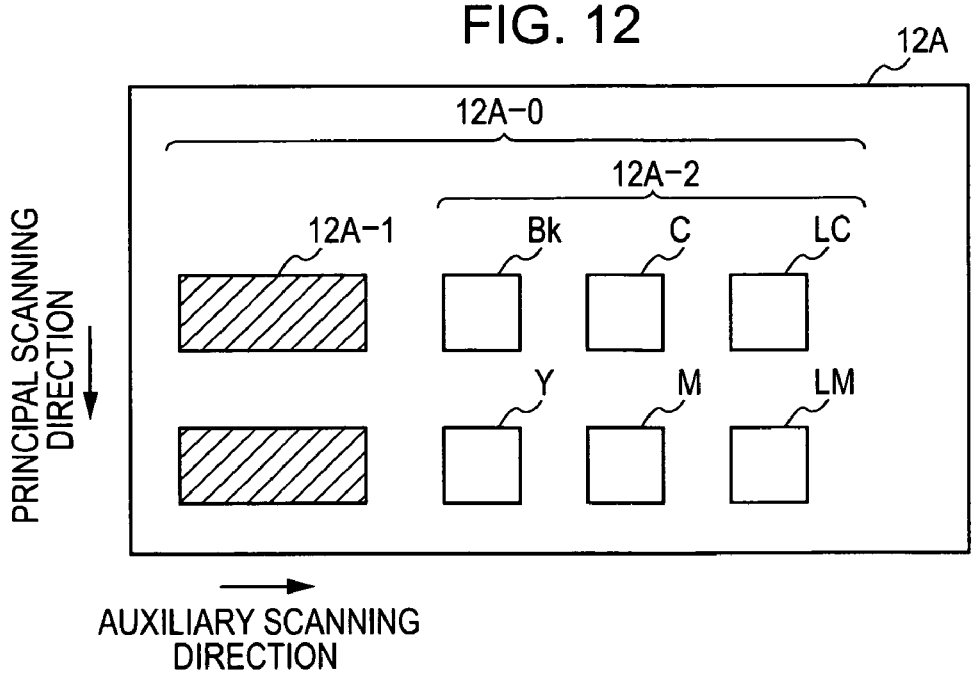
FIG. 12 illustrates a patch pattern used in gradation correction processing.
Figure 13:
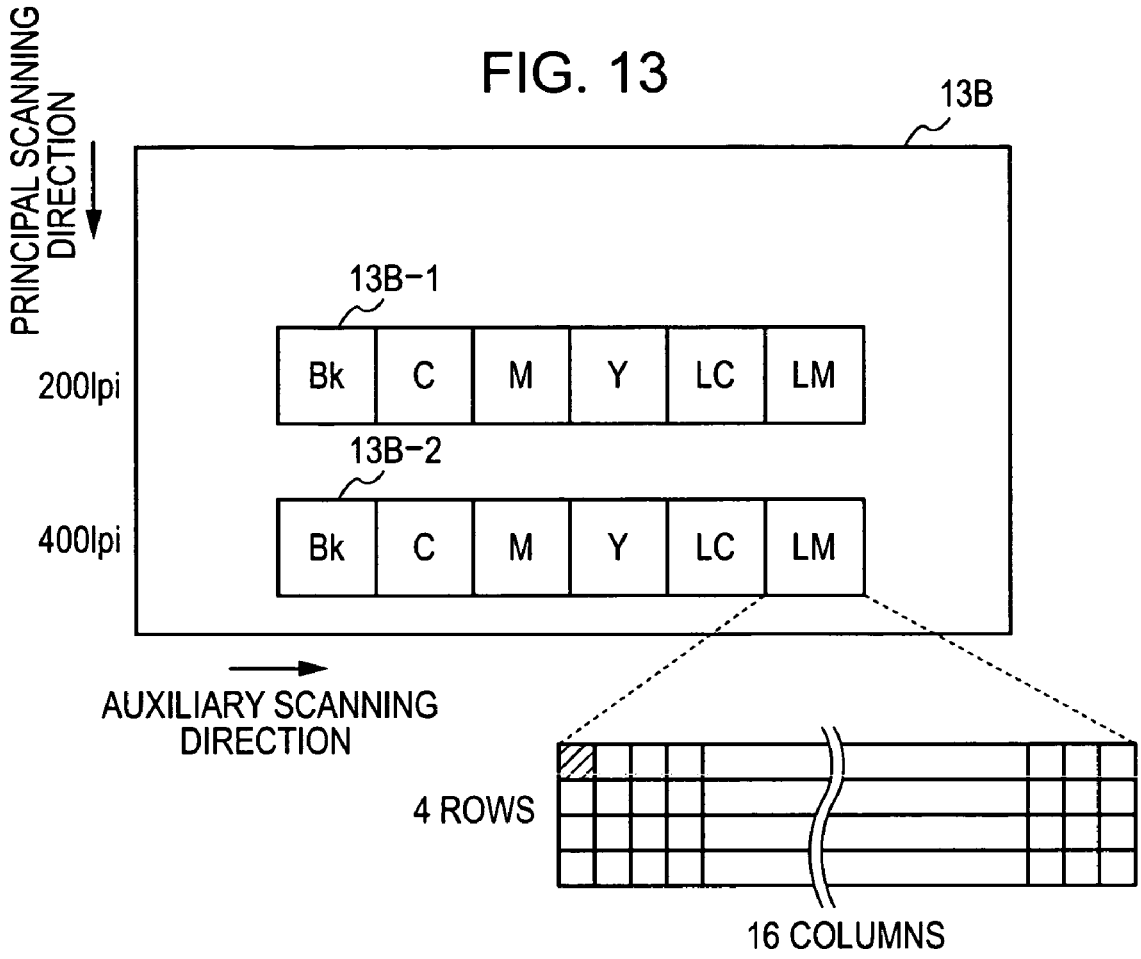
FIG. 13 illustrates the patch pattern used in the density correction processing.

Processing of density correction and gradation correction when a user selects the six-color mode will be described next with reference to FIGS. 12 and 13. FIG. 12 illustrates a six-color test print 12A used in gradation correction processing in the six-color mode and FIG. 13 illustrates a six-color test print 13B used in the density correction processing.

When it is determined that a user performs the adjustment in the six-color mode (Step S603 of FIG. 6), the six-color test print 12A having a test pattern 12A-0 shown in FIG. 12 formed thereon is output (Step S612 of FIG. 6). The test pattern 12A-0 is formed of a band pattern 12A-1 composed of halftone densities for six colors Y, M, C, Bk, LM (light magenta), and LC (light cyan); and a patch pattern 12A-2 composed of maximum density patches for colors Y, M, C, Bk, LM, and LC (density signal 255 levels). The contrast potential during the image forming of the six-color test print 12A has a standard initial value registered therein according to an environment for use.

At Step S613 in succession, the output six-color test print 12A is read by the sensor after fixing 99 (may also be read by the reader unit 300 by placing it on the document glass plate 31), and the obtained RGB values are converted into optical densities using the LUT 414. The method for correcting the maximum density from density information obtained in the dark toner is the same as that in the four-color mode; in the light toner, it is necessary to set the contrast potential by correcting the maximum density using the relationship between the surface relative potential for light toner of the photosensitive drum and the image density (Step S614 and Step S615 of FIG. 6). The method for obtaining the grid potential and the development bias potential is the same as in the four-color mode.

IV. Gradation Correction in Six-color Mode

Then, the six-color test print 13B is output (Step S616 of FIG. 6). When the six-color test print 13B is output, images are formed without operating the LUT 414. The six-color test print 13B, as shown in FIG. 13, is prepared with the patches 13B-1 and 13B-2 for colors Y, M, C, Bk, LM, and LC with the gradation of 4 rows×16 columns and 64 gradient levels in total. The patch 13B-1 has a resolution of 200 lpi and the patch 13B-2 has a resolution of 400 lpi.

Then, the output six-color test print 13B is read by the sensor after fixing 99 (may also be read by the reader unit 300 by placing it on the document glass plate 31), and the obtained RGB values are converted into optical densities using the LUT 414 (Step S617 of FIG. 6). Using the density information obtained, the same procedure as that of the maximum density correction control mentioned above is made. Furthermore, the content of the LUT 414 is calculated in the same way as in the gradation correction in the four-color mode mentioned above so as to establish the LUT 414 (Step S618 of FIG. 6).

As described above, according to the embodiment, the calibration is executed in accordance with each control for four/six color (FIG. 6), so that the four-color density and gradation correction and the six-color density and gradation correction can be selectively made so as to effectively correct variations in image density and gradation reproducibility for short and long periods in four-color and six-color modes.

Since the maximum density is set at a level higher than the final target value, irreproducible density portions are eliminated, improving reproducibility of image density.

The deteriorated gradation produced by changes in image output characteristics of dark toner and light-toner is corrected so that pseudo-contours in the intermediate density region are prevented from being generated, thus stably outputting high-quality images.

In the image-forming apparatus for forming images by switching resolution in accordance with the kind of images, by correcting gradation in forming patterns for each resolution, high-quality images can be stably output even when the gradation characteristics largely differ due to changes in resolution.

In both modes of when images are developed with dark toner and light toner and when being developed without the light toner, excellent gradation characteristics can be securely obtained.

The deteriorated gradation produced by changes in image forming characteristics of dark toner and light-toner is corrected, so that high-quality images can be stably output in both four-color and six-color modes.

Without being conscious of the present operating mode of the image-forming apparatus (high-quality color mode, normal color mode), a user can automatically select the mode conforming to the present color.

The adjustment can be selected between four-color and six-color modes, so that the adjustment time and the amount of toner used in the adjustment can be reduced to a smaller amount than in the case where both modes are continuously performed.

(Modifications)

According to the exemplary embodiment described above, the output density is measured using 16-point (16-gradient level) pattern of 256-gradient level input image signals divided in equal intervals as a patch pattern. Alternatively, in accordance with output characteristics of the image-forming apparatus, by increasing the number of points (gradient levels) in pattern formation or by adjusting intervals in pattern formation, the gradation correction can be executed more accurately.

In the image-forming apparatus described above, the gradation correction method of the image-forming apparatus with dark toner and light toner using two photosensitive bodies has been described. Alternatively, the method can be incorporated in the following tandem type image-forming apparatus.

The present invention is not limited to the apparatus according to the embodiment described above, so that it may be incorporated in a system composed of a plurality of instruments or in an apparatus including one instrument. This can be achieved by supplying a storage medium having program code (software) stored therein for achieving the functions according to the embodiment described above to the system or the apparatus, and the computer (or a CPU or a micro-processing unit (MPU)) of the system or the apparatus reads the program code stored in the storage medium so as to execute it.

In this case, the program code itself read out of the storage medium achieves the functions of the embodiment. The storage medium for supplying the program code may include a floppy disk, a hard disk, an optical disk, a magnetic optical disk, a compact disk-ROM (CD-ROM), a CD-recordable (CD-R), a magnetic tape, a non-volatile memory card, and a non-volatile memory. By executing the program code read out with the computer, not only the functions of the embodiment are achieved, but also an OS (operating system) operating on the computer on the basis of the instructions of the program code executes the practical processing partly or wholly so as to achieve the above-described functions.

Furthermore, after the program code is read out of the memory storage, it may be written into a memory provided in a feature expansion board inserted into the computer or a feature expansion unit connected to the computer. On the basis of the instructions of the program code, a CPU provided in the feature expansion board or the feature expansion unit executes the practical processing partly or wholly so as to achieve the above-described functions.

The present invention is not limited to the above-described embodiment, and various changes and modifications can be made thereto within the spirit and scope of the present invention. Therefore, to apprise the public of the scope of the present invention, the following claims are made.

This patent application claims priority from Japanese Patent Application No. 2004-357132 filed on Dec. 9, 2004 and Japanese Patent Application No. 2005-326147 filed on Nov. 10, 2005 which are hereby incorporated by reference herein in their entirety.

What is claimed is:

1. An image-forming apparatus for making development using light toner and dark toner with substantially the same hue, the image-forming apparatus comprising:

an operation unit configured to select an operation mode including a first mode forming images using the light toner and the dark toner, a second mode forming images without using the light toner, and an automatic selection mode;

a control unit configured to select an adjustment based on the operation mode selected by the operation unit, a first adjustment being selected when the operation mode is the first mode, a second adjustment being selected when the operation mode is the second mode, and any one of the first adjustment and the second adjustment being selected based on a default operation mode selected for operating the image-forming apparatus when the operation mode is the automatic selection mode; and a processing unit configured to make development based on the adjustment selected by the control unit.

2. The image-forming apparatus according to claim 1, wherein the first adjustment makes the density correction and the gradation correction based on the fixed images on the recording sheet, for which the dark toner and the light toner are used, while the second adjustment makes the density correction and the gradation correction based on the fixed images on the recording sheet without the light toner used.

3. The image-forming apparatus according to claim 1, wherein the operation unit is further configured to allow a monochrome mode forming monochrome images as the operation mode, the image-forming apparatus further comprising:

an input unit configured to input an image signal, wherein the control unit is configured to select the operation mode based on the image signal from the input unit.

4. The image-forming apparatus according to claim 1, wherein the operation unit is configured to select the operation mode based on a user input.

5. An image adjusting method in an image-forming apparatus for making development using light toner and dark toner with substantially the same hue, the image-forming apparatus including, as operation modes of the image-forming apparatus, a first mode forming images using the light toner and the dark toner, a second mode forming images without using the light toner, and an automatic selection mode making density correction and gradation correction based on fixed images on a recording sheet, the image adjusting method comprising:

obtaining the operation mode;

determining an adjustment based on the operation mode, where the adjustment is determined to be a first adjustment when the operation mode is the first mode, the adjustment is determined to be a second adjustment when the operation mode is the second mode, and the adjustment is determined to be any one of the first adjustment and the second adjustment based on a default operation mode selected for operating the image-forming apparatus when the operation mode is an automatic selection mode; and making development based on the adjustment.

6. The image adjusting method according to claim 5, wherein the first adjustment makes the density correction and the gradation correction based on the fixed images on the recording sheet, for which the dark toner and the light toner are used, while the second adjustment makes the density correction and the gradation correction based on the fixed images on the recording sheet without the light toner used.

7. The image adjusting method according to claim 5, further comprising:

determining if the operation mode is a monochrome mode; and inputting, if the operation mode is determined to be the monochrome mode, an image signal, and wherein the determining the adjustment further determines the adjustment to be any one of the first adjustment and the second adjustment based on a default operation mode selected for operating the image-forming apparatus when the operation mode is the monochrome mode.

8. The image adjusting method according to claim 5, wherein the obtaining the operation mode comprises obtaining the operation mode based on a user input.

* * * * *